US011617453B2

(12) United States Patent
Wechsler

(10) Patent No.: US 11,617,453 B2
(45) Date of Patent: Apr. 4, 2023

(54) SHIELD FOR HIGH CHAIR

(71) Applicant: Alain Wechsler, Brooklyn, NY (US)

(72) Inventor: Alain Wechsler, Brooklyn, NY (US)

( * ) Notice: Subject to any disclaimer, the term of this patent is extended or adjusted under 35 U.S.C. 154(b) by 110 days.

(21) Appl. No.: 17/346,258

(22) Filed: Jun. 13, 2021

(65) Prior Publication Data

US 2022/0395111 A1 Dec. 15, 2022

(51) Int. Cl.

| | |
|---|---|
| ***A47D 15/00*** | (2006.01) |
| ***A47G 19/30*** | (2006.01) |
| ***A47D 1/00*** | (2006.01) |

(52) U.S. Cl.

CPC ..... *A47D 15/00* (2013.01); *A47D 1/008* (2013.01); *A47G 19/30* (2013.01)

(58) Field of Classification Search

CPC . A47B 13/08; A47B 95/043; A47B 2095/046; A47D 15/005; A47D 7/02; A47C 7/66; A47C 7/666; A47F 9/00; A47F 2010/065; B60R 2021/022; A61G 7/0509; A61G 7/0512; A61G 7/0513; A61G 7/0515; A61G 7/0516

See application file for complete search history.

(56) References Cited

U.S. PATENT DOCUMENTS

| | | | | |
|---|---|---|---|---|
| 220,258 | A | | 10/1879 | Stevens |
| 837,570 | A | | 12/1906 | Jackson et al. |
| 1,050,205 | A | | 1/1913 | Conley |
| 1,103,597 | A | | 7/1914 | Lynch |
| 1,242,074 | A | | 10/1917 | Thomas |
| 1,253,044 | A | | 1/1918 | Kapelman |
| 1,309,343 | A | | 7/1919 | Thomas |
| 1,339,527 | A | | 5/1920 | Sperling et al. |
| 2,485,907 | A | | 10/1949 | Montoya |
| 2,540,685 | A | | 2/1951 | Mayer |
| 2,807,312 | A | | 9/1957 | Florian |
| 2,981,583 | A | | 4/1961 | Eisenberg |
| 3,328,078 | A | | 6/1967 | Whitley, Jr. |
| 3,512,829 | A | | 5/1970 | Paris |
| 3,601,065 | A | | 8/1971 | Sargent |
| 3,848,921 | A | | 11/1974 | Rhodes |
| 3,921,233 | A | * | 11/1975 | Mann ..... A47D 7/02 5/100 |
| 4,030,748 | A | | 6/1977 | Brock |
| 4,131,312 | A | | 12/1978 | Price |
| 4,449,763 | A | | 5/1984 | Barnett |
| 4,579,385 | A | | 4/1986 | Koenig |
| 4,923,249 | A | | 5/1990 | Mattox |
| 5,074,616 | A | | 12/1991 | Smith |
| 5,184,865 | A | | 2/1993 | Mohtasham et al. |
| 5,188,421 | A | | 2/1993 | Arseneault |

(Continued)

FOREIGN PATENT DOCUMENTS

| | | | |
|---|---|---|---|
| CN | 112425901 A | * | 3/2021 |
| CN | 213428933 U | * | 6/2021 |
| WO | 2017096226 A1 | | 6/2017 |

*Primary Examiner* — David E Allred
(74) *Attorney, Agent, or Firm* — M&B IP Analysts, LLC

(57) ABSTRACT

A shield for a tray for a high chair that in a first configuration prevents or minimizes a child's opportunity to dispose of food over and around the shield and in a second configuration, with the shield still remaining attached to the high chair allows, for easy access to the tray, e.g., during the feeding process with the child in the chair.

20 Claims, 21 Drawing Sheets

(56) References Cited

U.S. PATENT DOCUMENTS 5,290,058 A * 3/1994 Adams ..... A61G 12/001 280/47.35
5,299,336 A 4/1994 Marteeny
5,348,368 A 9/1994 Garcia et al.
5,507,550 A 4/1996 Maloney
5,730,490 A 3/1998 Mortenson
5,810,432 A 9/1998 Haut et al.
5,947,034 A 9/1999 Belka et al.
5,975,558 A 11/1999 Sittu
6,033,019 A 3/2000 Hession-Kunz et al.
6,039,393 A 3/2000 Roh
6,203,102 B1 3/2001 Helmsderfer et al.
6,224,073 B1 5/2001 Au
6,302,440 B1 10/2001 Goodstein
6,428,098 B1 8/2002 Allbaugh
6,484,989 B1 11/2002 Connery
6,561,915 B2 5/2003 Kelly et al.
6,578,496 B2 6/2003 Guard et al.
6,851,375 B2 2/2005 Guard et al.
6,916,249 B2 7/2005 Meade
6,920,830 B1 7/2005 Asbach et al.
7,007,999 B1 3/2006 Schneller
7,011,363 B1 3/2006 Connery
7,150,499 B2 12/2006 McGregor
7,213,878 B2 5/2007 Delapaz
7,318,380 B2 1/2008 Guard et al.
7,328,941 B2 2/2008 Asbach et al.
7,490,558 B2 2/2009 Asbach et al.
7,540,560 B1 6/2009 Connery
7,871,125 B2 1/2011 Asbach et al.
7,891,732 B2 2/2011 Hei et al.
8,534,751 B2 9/2013 Hei et al.
8,540,312 B2 9/2013 Asbach et al.
8,851,097 B2 10/2014 Vieira et al.
D787,224 S 5/2017 Bracho
D801,709 S 11/2017 Stone et al.
10,463,557 B2 * 11/2019 Wakabayashi ..... A61G 11/008
2003/0005520 A1 * 1/2003 Hofer ..... A47D 7/02 5/100
2004/0244288 A1 12/2004 Kirkpatrick
2004/0244301 A1 12/2004 Dickson et al.
2005/0115376 A1 * 6/2005 Jimenez ..... B23D 47/04 83/466
2005/0126445 A1 6/2005 Guard et al.
2005/0126446 A1 6/2005 Nobles et al.
2005/0151034 A1 * 7/2005 Shendelman ..... A47G 19/30 248/121
2005/0258612 A1 11/2005 Wang
2005/0263038 A1 12/2005 Asbach et al.
2005/0275257 A1 12/2005 McGregor
2006/0082183 A1 4/2006 Hudson
2007/0257526 A1 11/2007 Hei et al.
2008/0185880 A1 8/2008 Romaniuk
2009/0127917 A1 5/2009 Foenander
2010/0066119 A1 3/2010 Levine et al.
2011/0101742 A1 5/2011 Hei et al.
2011/0214383 A1 9/2011 Yaraei
2012/0062001 A1 3/2012 Krasley
2012/0286546 A1 11/2012 Ballard et al.
2013/0134743 A1 5/2013 Hazim
2014/0021751 A1 1/2014 Lang et al.
2015/0320234 A1 11/2015 Ing et al.
2016/0331152 A1 11/2016 Wells
2017/0259704 A1 * 9/2017 Madaras ..... B60R 21/207

* cited by examiner

SHIELD FOR HIGH CHAIR

TECHNICAL FIELD

This invention relates to accessory devices for high chairs of the type used for seating infants and young children.

BACKGROUND OF THE INVENTION

High chairs are commonly used to seat infants and young children during meals. High chairs have a seat for the infant or young child, and have a tray upon which the child's meal is placed. The tray is securely coupled to the frame of the chair.

Young children often tend to be messy eaters. In addition to getting food all over themselves, their bibs and clothes, they throw and knock food off the high chair tray. The food that is displaced from the high chair tray lands on the floor and other nearby objects such as furniture, rugs, etc. The floor and other nearby objects must then be cleaned up, which creates extra work for the child's parents. Baby foods in thin paste form in particular seem to be susceptible of being displaced from the tray and onto surrounding objects. These same pasty foods are difficult to clean up. Occasionally, the displaced food permanently stains the floor or nearby objects, damaging the looks and value of the floor or objects.

One prior art solution to this problem is disclosed in U.S. Pat. No. 5,348,368 issued to Garcia et al. on Sep. 20, 1994. This patent discloses a shield apparatus made up of a wall and securing means. The shield has dimensions such that the member partially encompasses a high chair tray's eating surface and prevents the high chair occupant from disposing food over and around the member when the shield is located on the high chair tray. The wall of the shield serves to block disposal of food over the front and sides of the tray. The securing means of the shield couples with the high chair tray to prevent the shield from being dislodged by the high chair occupant, holding the shield firmly to the high chair tray.

The shield is oriented vertically, located on the tray, and secured to the tray so that the shield forms a barrier around the tray. The shield is removed from the tray by uncoupling the securing means from the tray and lifting the shield off the tray. The shield may then be cleaned and subsequently reattached to the tray, or folded up and stored away.

SUMMARY OF THE INVENTION

I have recognized that, while such an arrangement is reasonably effective in preventing the messing of the floor and nearby objects, disadvantageously it is difficult to access the tray during the child feeding process in that access must be made from over the top of the shield or from behind the child. Access to the tray and/or child is often desirable in order to add or remove food from the tray as well as in order to clean up spills, e.g., of liquids, that may occur and which, for example, through inadvertent actions of the child, could get on the child's clothes, e.g., the sleeves thereof.

Therefore, provided in accordance with the principles of the invention, is a shield for a tray for a high chair that in a first configuration while attached to the high chair, e.g., to the tray thereof, prevents or minimizes a child's opportunity to dispose of food over and around the shield and in a second configuration, with the shield still remaining attached to the high chair, e.g., to the tray thereof, allows for easy access to the tray, e.g., during the feeding process with the child in the chair.

In accordance with an aspect of the invention, the shield may be composed of at least two portions that meet when the shield is in the first configuration, such that the shield is closed, at least one of the portions being moveable, e.g., repositionable, so as to be separated from the other portion and so to provide a closeable opening for access to the tray when the shield is in the second configuration. Such motion may maintain the moved portion of the shield in essentially the same aspect with respect to the upper surface of the tray. The shield may include one or more locking mechanisms to hold at least the two portions together. Advantageously, thus, the shield is closeable to be in the first configuration and openable at least partway to be in the second configuration in which material may be easily added to or removed from the tray as well as to provide access for cleaning.

In one embodiment, one or more of the portions of the shield may retract, e.g., slide back from a point at which the sliding portion meets another portion of the shield. In another embodiment at least one of the portions of the shield may be made of sections designed to retract by sliding to be adjacent to each other. In yet a further embodiment of the invention, at least one of the portions of the shield may be made of a material that expands, e.g., stretches, and contracts, e.g., returns to original size, in an accordion-like manner, such as being foldable back upon itself. In such an embodiment to close the shield thus place it in the first configuration the material is stretched to lengthen it and to open the shield and thus place it in the second configuration the material is released to a more contracted state. In one embodiment at least one of the portions of the shield may be made of sections designed to slide into one another, e.g., in a telescopic arrangement.

In accordance with another aspect of the invention, the shield may be arranged so as to moved up or down with respect to the surface of the tray. In one such embodiment, the shield is arranged in the first configuration to be in an upward position with respect to the surface of the tray on which the child's food is place, thus preventing or minimizing a child's opportunity to dispose of food over and around the shield when the shield is in the upward position. In the second configuration, the shield is slid at least somewhat downward with respect to the surface of the tray on which the child's food is place, thus providing easy access to the tray. A sealing lip may be employed in such an embodiment around the tray so as to prevent material from slipping between the shield and the tray.

DETAILED DESCRIPTION

The following merely illustrates the principles of the invention. It will thus be appreciated that those skilled in the art will be able to devise various arrangements that, although not explicitly described or shown herein, embody the principles of the invention and are included within its spirit and scope. Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

In the claims hereof any element expressed as a means for performing a specified function is intended to encompass any way of performing that function. The invention as defined by such claims resides in the fact that the functionalities provided by the various recited means are combined and brought together in the manner which the claims call for. Applicant thus regards any means which can provide those functionalities as equivalent as those shown herein.

In the description, identically numbered components within different ones of the FIGS. refer to the same components.

Figure 1:
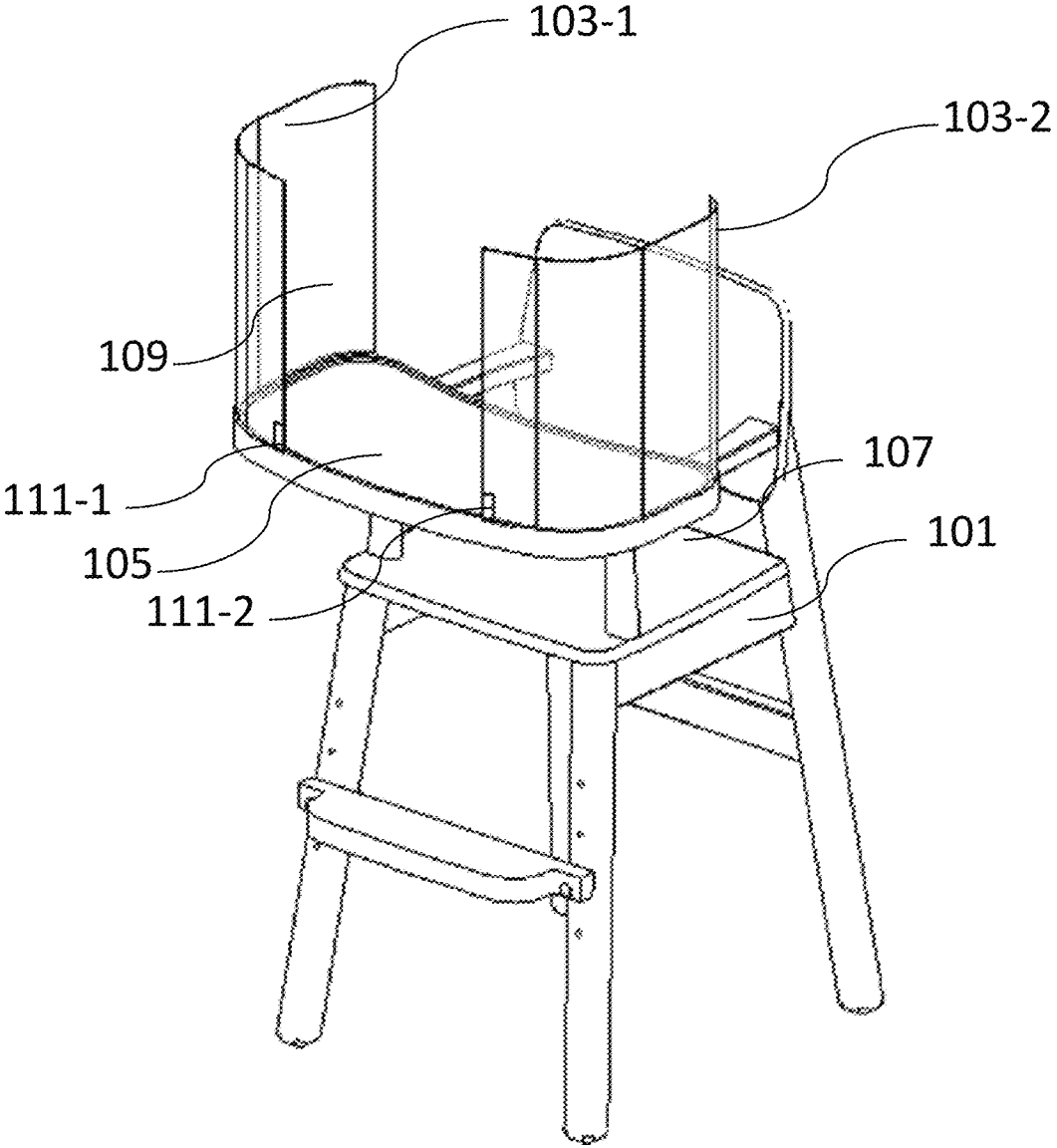
FIG. 1 shows a three-dimensional view of an illustrative highchair having a tray to which is mounted a shield made of two sections, the shield being openable and closeable, at least partway, to allow for easy access to the tray in accordance with the principles of the invention.

FIG. 1 shows a three-dimensional view of an illustrative highchair 101 having a tray 105 to which is mounted shield 103, made of two sections, 103-1 and 103-2, shield 103 being closeable so as to achieve a first configuration that prevents or minimizes a child's opportunity to dispose of food over and around the shield and openable, at least partway, to achieve a second configuration that allows for easy access to tray 105, e.g., during the feeding process with a child (not shown) positioned seated on seat 107, while still tray 105 remains attached to high chair 101, in accordance with the principles of the invention.

In an embodiment, shield 103 may be made of flexible plastic sheeting or similar material that has sufficient rigidity to maintain its shape and upright standing while yet being flexible enough to curve in accordance with a guide or track on tray 105. In one embodiment, the flexible plastic sheeting has a thickness of approximately one eighth of an inch. Various types of flexible plastic sheeting such as are known in the art, e.g., Plexiglas or other acrylic sheet products, or become known in the art, may be employed.

In FIG. 1, shield 103 is shown in the second configuration, i.e., the open position, by which is meant that sections 103-1 and 103-2 are retracted, i.e., slid back away from each other, to create opening 109. Also shown are handles 111-1 and 111-2, collectively herein handles 111, which can be used to separate sections 103-1 and 103-2 from each other to create opening 109 or to move sections 103-1 and 103-2 together into the first configuration, i.e., the closed position. Although somewhat difficult to see in FIG. 1, handles 111 should protrude at least slightly from shield sections 103-1 and 103-2 to enable a person to grab them and use them to slide shield sections 103-1 and 103-2 and thereby transition shield 103 from the open position to the closed position and vice-versa. Advantageously, when shield 103 is in the open position material, e.g., food, drink or their remnants may be easily added to or removed from tray 105.

In one embodiment, handles 111 may include a mechanism, not shown in FIG. 1, to enable locking of the shield in the closed position, thereby preventing a child sitting in the high chair from opening the shield on their own.

Note that the size of opening 109, as well as the size and shapes of sections 103-1 and 103-2 and even highchair 101 is illustrative only and is not to be deemed limiting.

Figure 2:
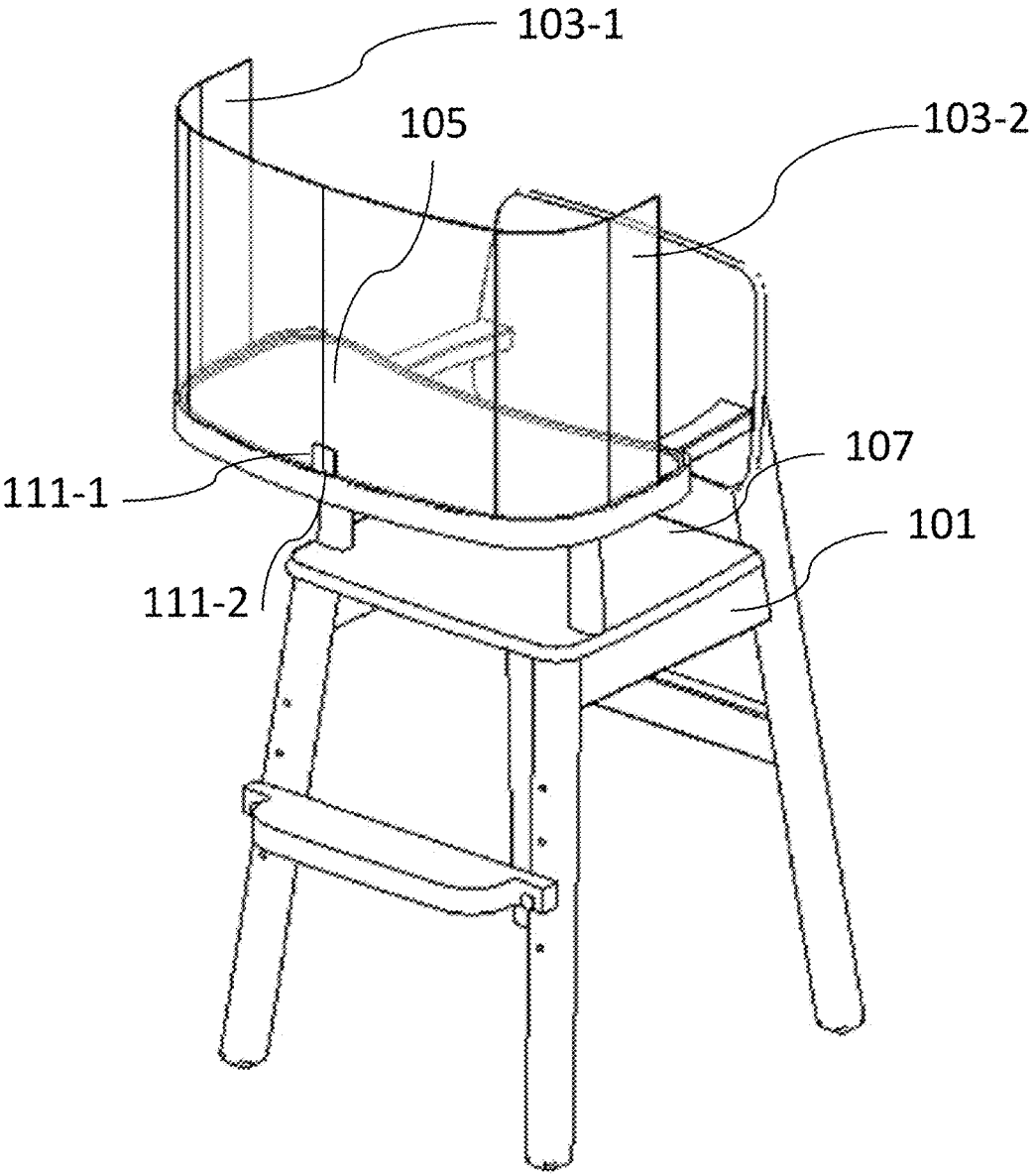
FIG. 2 shows the same view of highchair of FIG. 1 but where sections have been slid together so that shield is in the closed position.

FIG. 2 shows the same view of highchair 101 as in FIG. 1 but where sections 103-1 and 103-2 have been slid together so that shield 103 is in the closed position, thus eliminating opening 109. Advantageously, in the closed position, shield 103 provides a barrier such that a child seated on seat 107 is generally prevented from disposing food over and around the front and sides of tray 105.

Figure 3:
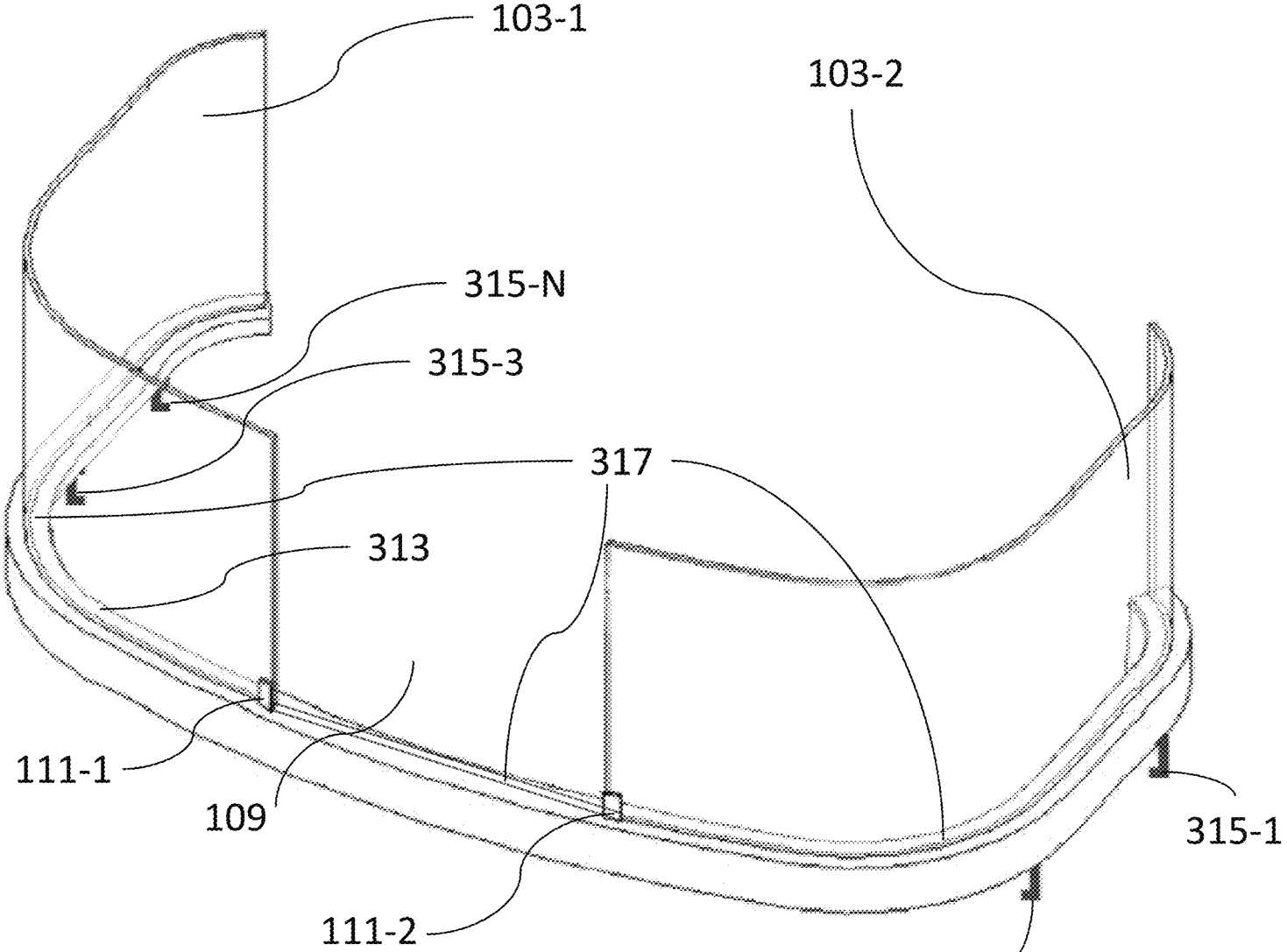
FIG. 3 is an enlarged view of the shield of FIG. 1 that to enable one to see a mechanism for mounting the shield to the tray.

FIG. 3 is an enlarged view of shield 103 that is mountable on tray 105 (FIG. 1) to enable one to see a mechanism for mounting shield 103 to tray 105 (FIG. 1). Shown in FIG. 3 is track 313 which, in one embodiment, is removably attachable to tray 105 (FIG. 1) by clips 315-1 through 315-N, where N is an integer, referred to collectively hereinafter as clips 315. Although 4 clips are shown in FIG. 3, any integer number of clips may be employed. In one embodiment, clips 315 are separate units that are used to clip track 313 to tray 105 (FIG. 1). In another embodiment, clips 315 may be built into, e.g., integrally molded with, track 313. In yet a further embodiment of the invention, track 313 may itself be part of tray 105 (FIG. 1), e.g., integrally molded therewith. Track 313 may be made of various materials, as will be apparent to those of ordinary skill in the art. For example, track 313 may be made of plastic, rubber, rubber substitutes, metal, or a combination thereof.

Within track 313 may be formed groove 317 into which is inserted sections 103-1 and 103-2 of shield 103 in a manner enabling them to slide within groove 317 thus enabling the shield to be opened or closed in accordance with the principles of the invention. It should be appreciated that although track 313 is shown as a single track it may be formed out of several sections.

Although track 313 is shown as being mounted along the outer edge of tray 313, this is not required and track 313 may be further interior to tray 105 (FIG. 1) with respect to its outer edge in various embodiments.

Figure 4:
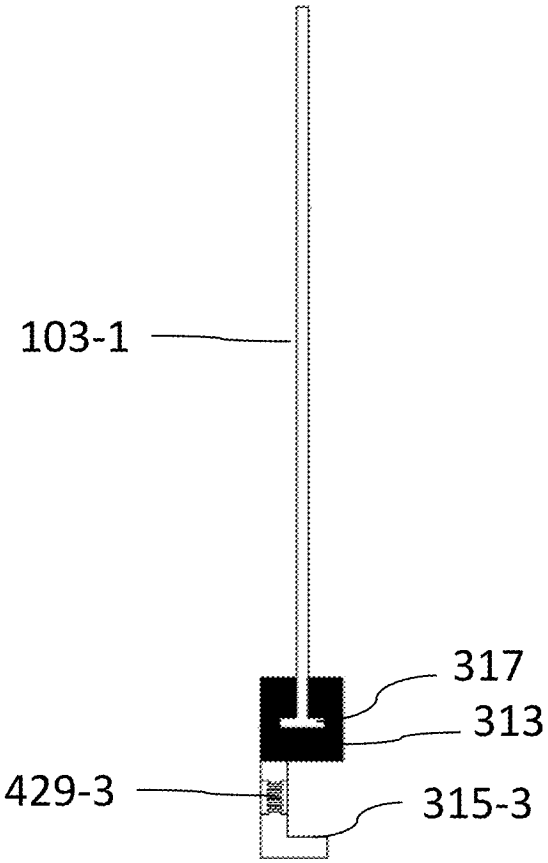
FIG. 4 shows an illustrative arrangement of one of the clips, the track and one of the shield sections of FIG. 3.

FIG. 4 shows a cross-sectional view of illustrative arrangement of one of clips 315, track 313, and shield section 103-1. In the embodiment shown in FIG. 4, track 313 has within it groove 317 which has inverted "T" shape. Shield section 103-2 has a matching inverted "T" shape portion such that when it is inserted into groove 317 will be generally held therein and be able to slide therethrough. The height of track 313 is at the discretion of the implementer but should be sufficient to allow shield 103 to be securely held thereby. In one embodiment, the height of track 313 may be around 3 inches. Groove 317 may penetrate most of the way into track 313 so as to provide a good grip and hold on shield section 103-1 so as to maintain it stably in the upright position. In one embodiment, shield section 103-1 may be inserted into groove 317 by bending the portion of track 313 that is oppositely located from clip 315-2 to somewhat temporarily widen groove 317 so that shield section 103-1 may be placed therein. The same would apply correspondingly shield section 103-1.

As the design of high chair trays varies, in various embodiments clips 315 may be appropriately shaped so that they are adapted to properly grip at least one high chair tray style. Thus, clip 315-3 shown in FIG. 4 is illustrative only. In some embodiments, clips 315 may be spring loaded. Clip 315-3 may be somewhat inherently elastic. Element 429-3 merely represents for illustrative purposes that clip 315-3 typically has some springiness to it but it need not be an actual element of clip 315-3. In some embodiments, the bottom of the clips may be curved or slanted, e.g., upward or downward. In other embodiments, there may be gripping features molded or attached to the clip. In further embodiments a screw member or similar such item may go through the bottom of the clip to effectuate a clamp or vice grip. In yet further embodiments a ratcheting mechanism may be employed as part of the clip. All of the clips used in any embodiment need not be the same, e.g., they need not all be of the same type, size, or design, especially when one recognize that high chair trays are not necessarily uniform at all points around their exterior edge.

Typically track 313 will rest on the high chair tray 105 (FIG. 1) and clips 313 will hold it securely thereto so that mechanical stability is provided. It may also be arranged that the track is mounted so as to minimize the chance, or amount, of any spilled liquid or thrown food getting in between track 313 and the tray.

Figure 5:
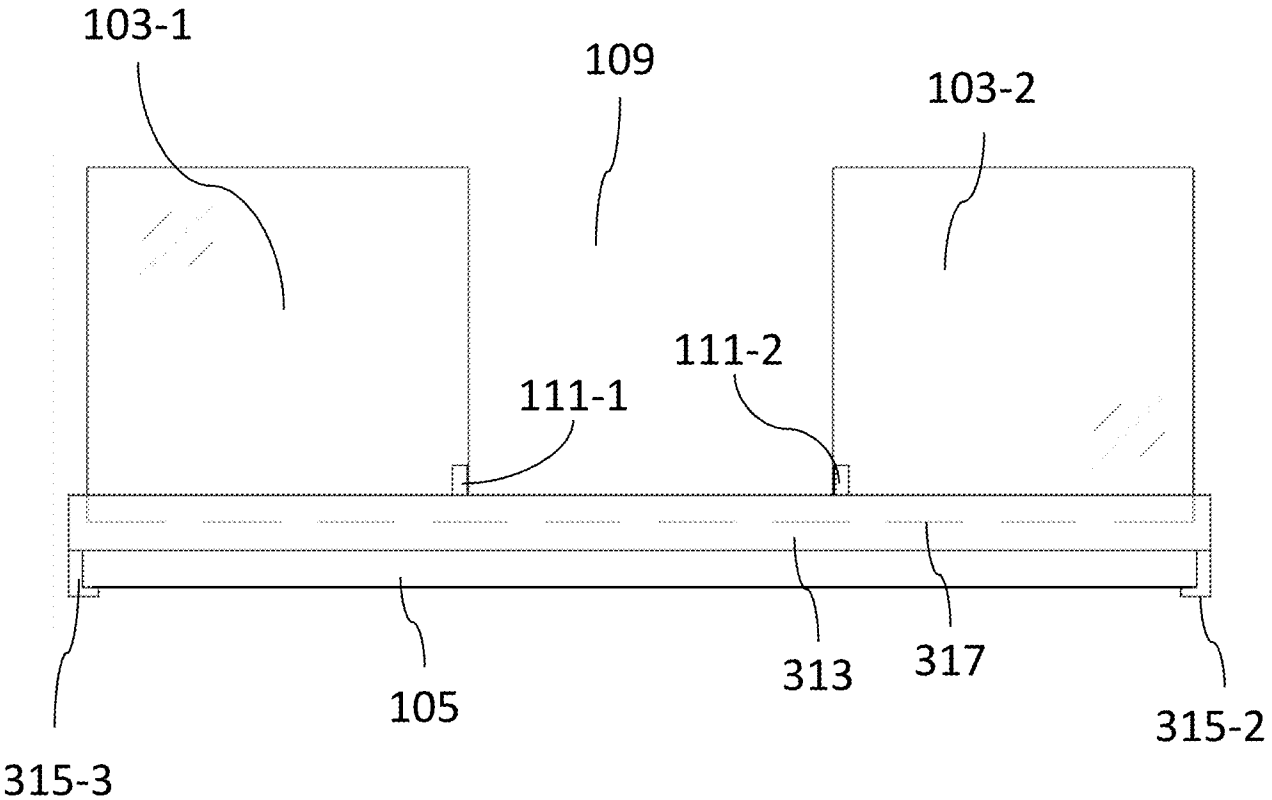
FIG. 5 shows an elevation view straight on from the front of the tray of FIG. 1 for an embodiment.

FIG. 5 shows an elevation view straight on from the front of tray 105 for an embodiment. This enables one to see how clips 315 hold track 313 onto tray 105. The thicknesses of track 313 and tray 105 are merely illustrative and there is no requirement with regard to the thickness of either. The dashed line represents the position of track 317 which is not actually visible in the view of FIG. 5.

Figure 6:
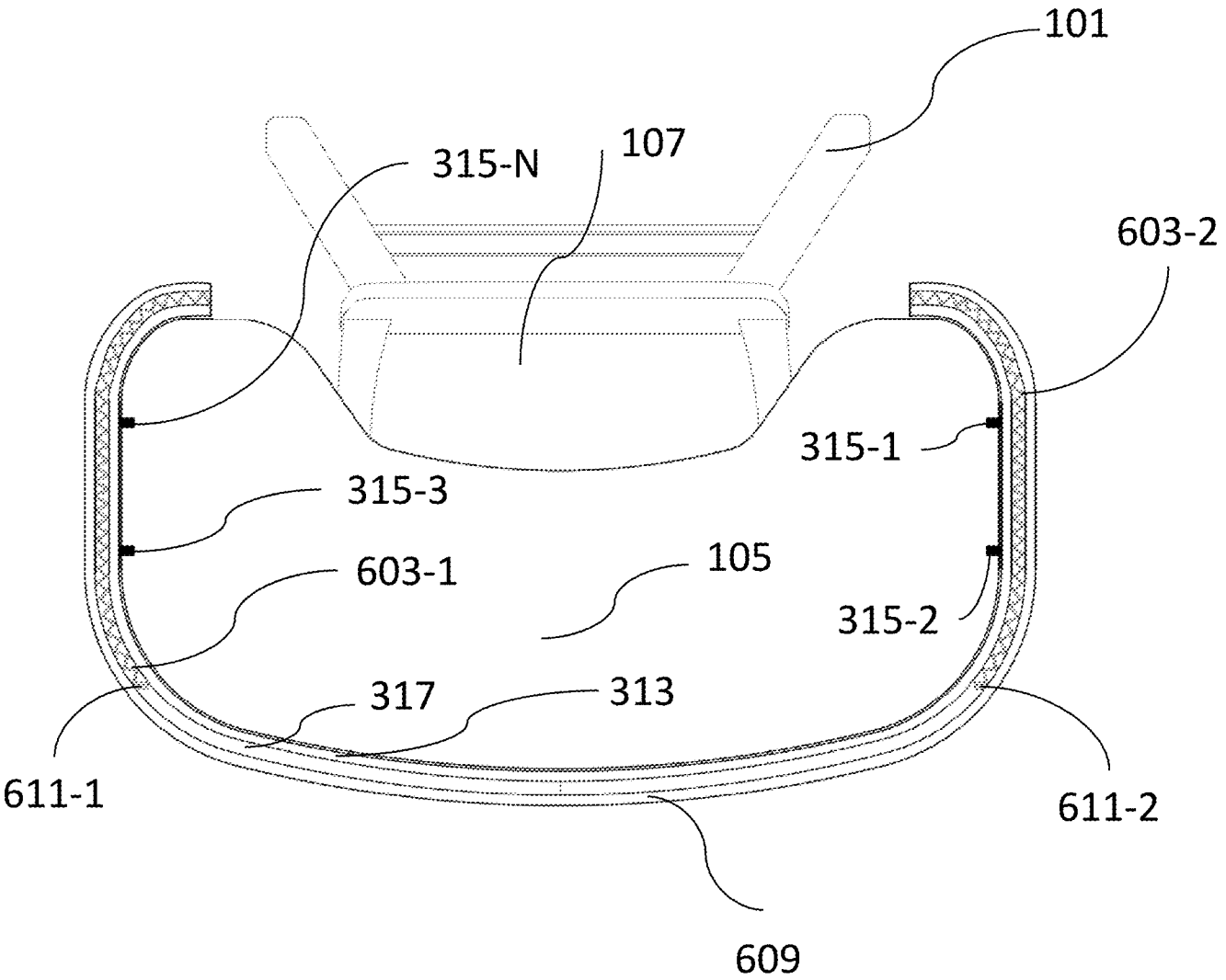
FIG. 6 shows a top view of a highchair having a tray to which is mounted another embodiment of the shield which is made of two sections, where at least one section is arranged as pleats that collapse in an accordion-like manner, in accordance with an aspect of the invention.

FIG. 6 shows a top view of highchair 101 including tray 105 to which is mounted another embodiment of the inventive shield, shield 603, made of two sections, 603-1 and 603-2, shield 603 being openable and closeable, at least partway, to allow for easy access to tray 105, e.g., during the feeding process with a child (not shown) positioned seated on seat 107, while still tray 105 remains attached to high chair 101.

Similar to the embodiment shown in FIG. 1, shield 603 may be made of flexible plastic sheeting that has sufficient rigidity to maintain its shape and upright standing while yet being flexible enough to curve in accordance with a guide or track on tray 105. In the embodiment shown in FIG. 6 the flexible plastic sheeting of shield 603 is arranged as pleats that collapse in an accordion-like manner, in accordance with an aspect of the invention. As a result, opening of the shield is achieved by effectively contracting a length of at least one of shield sections and closing of the shield is achieved by effectively extending a length of at least one of shield sections. In one embodiment, the flexible plastic sheeting has a thickness of approximately one eighth of an inch. Various types of flexible plastic sheeting such as are known in the art, e.g., Plexiglas or other acrylic sheet products, or become known in the art, may be employed.

In FIG. 6, shield 603 is shown in the open position, by which is meant that shield sections 603-1 and 603-2 are retracted, i.e., slid back away from each other and in a collapsed position, to create opening 609. Advantageously, when shield 603 is in the open position material, e.g., food, drink or their remnants may be easily added to or removed from tray 105. Further advantageously, because the flexible plastic sheeting of shield 603 is arranged as pleats that collapse in an accordion-like manner, opening 609 may be larger than, for example, opening 109 (FIG. 1) when the same track length and length of shield when extended is employed. The material of the shield in such an embodiment may be considered to be stretching and retracting. Also shown in FIG. 6 are handles 611, which include handles 611-1 and 611-2, respectively, for use in opening and closing shield 603.

Also shown in FIG. 6 is track 313 which, in one embodiment, is removably attached to tray 105 by clips 315-1 through 315-N, where N is an integer, referred to collectively hereinafter as clips 315. Although 4 clips are shown in FIG. 6, any integer number of clips may be employed. Within track 313 may be formed groove 317 into which is inserted sections 603-1 and 603-2 of shield 603 in a manner enabling them to slide within groove 317 and to open and close in an accordion-like manner, thus enabling the shield to be opened or closed in accordance with the principles of the invention. It should be appreciated that although track 313 is shown as a single track it may be formed out of several sections.

Figure 7:
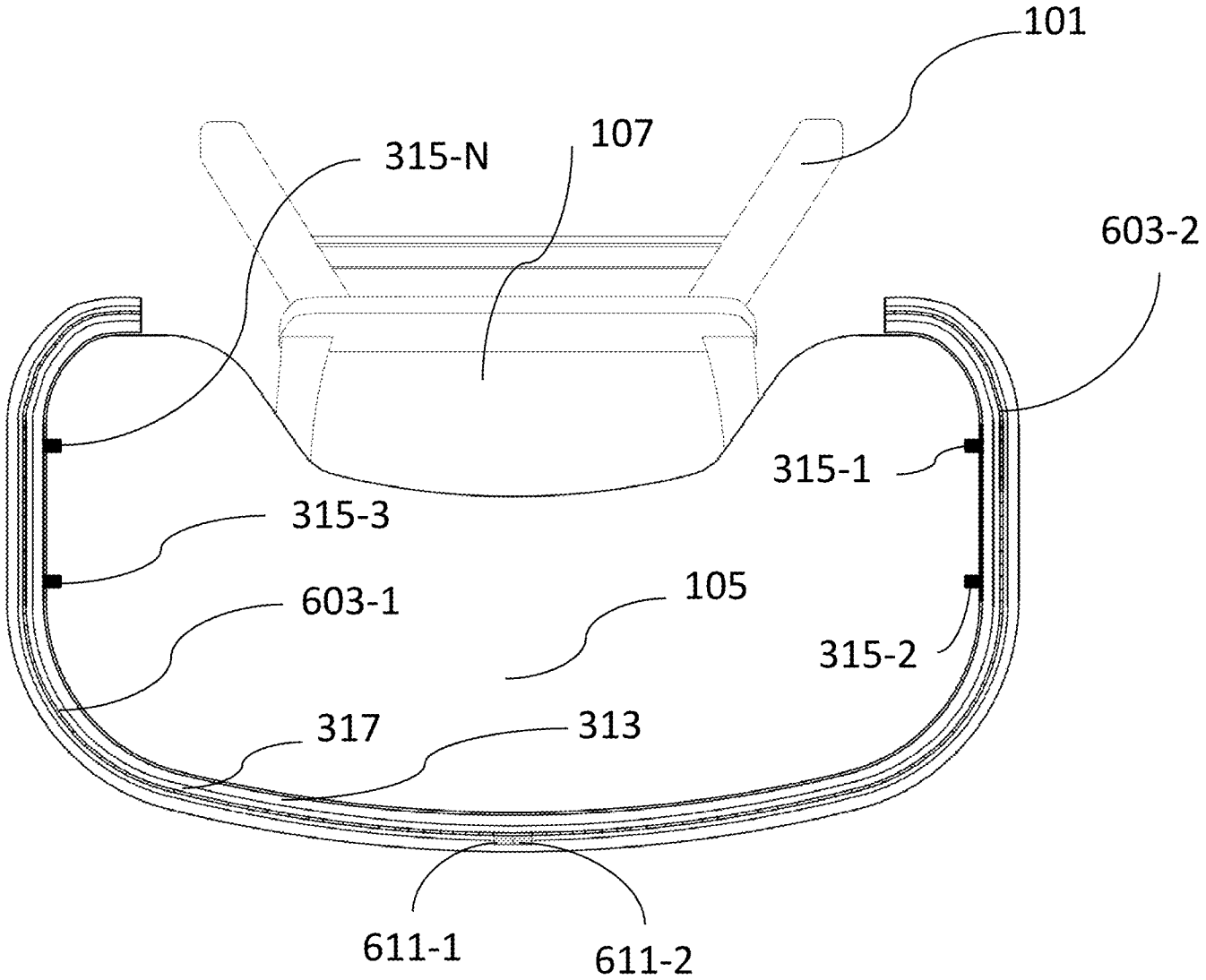
FIG. 7 shows the same view as FIG. 6 but where the sections of the shield have been slid together so that the shield is closed.

FIG. 7 shows the same view as FIG. 6 but where sections 603-1 and 603-2 have been slid together so that the shield is closed, and hence there is no opening 609. Advantageously, in the closed position, shield 603 provides a barrier such that a child seated on seat 107 is generally prevented from disposing food over and around the front and sides of tray 105. Also shown in FIG. 7 are handles 611, which include handles 611-1 and 611-2, respectively, for use in opening and closing shield 603.

Figure 8:
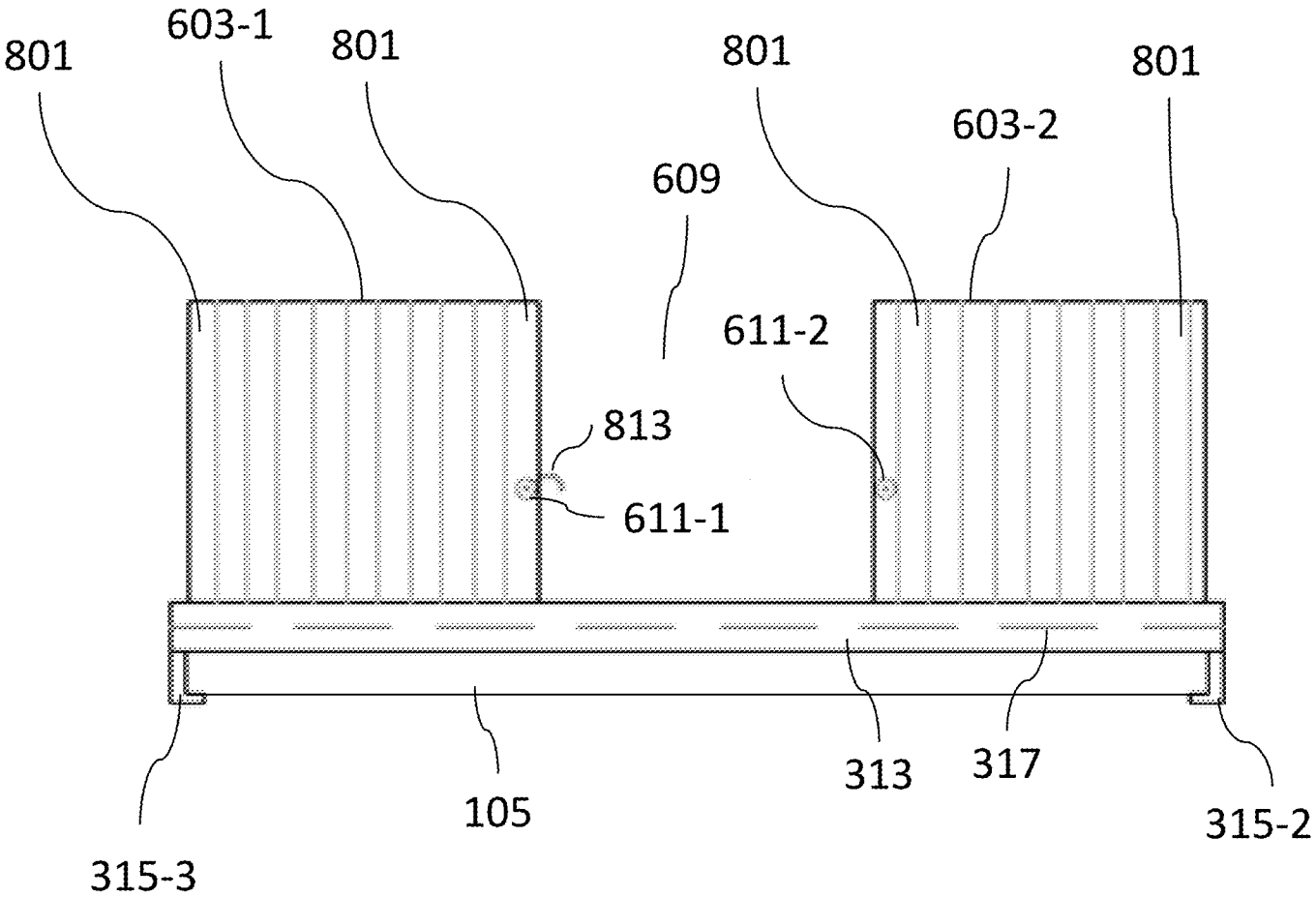
FIG. 8 shows an elevation view straight on from the front of the tray of the embodiment of FIG. 6 where shield sections open and close in an accordion-like manner and the shield is open.

FIG. 8 shows an elevation view straight on from the front of tray 105 for the embodiment shown in FIG. 6 where shield sections 603 open and close in an accordion-like manner. This enables one to see how clips 315 hold track 313 onto tray 105. The thicknesses of track 313 and tray 105 are merely illustrative and there is no requirement with regard to the thickness of either. The dashed line represents the position of track 317 which is not actually visible in the view of FIG. 8.

Again shown in FIG. 8 are handles 611 for use in opening and closing shield 603. In one embodiment, handles 611 may include a mechanism to enable locking of the shield in the closed position, thereby preventing a child sitting in the high chair from opening the shield on their own. For example, in the manner shown in FIG. 8, a hook closing mechanism may be employed where hook 813 is on one of handles 611, e.g., handle 611-1 and slides over the other of handles 611, e.g., handle 611-2. In another embodiment, the locking mechanism may be separate from the handles, or a combination of the two options may be employed.

Also visible in FIG. 8 are some of individual panels 801 that make up shield sections 603-1 and 603-2. In FIG. 8 sections 603-1 and 603-2 have been slid apart so that the shield is open.

Figure 9:
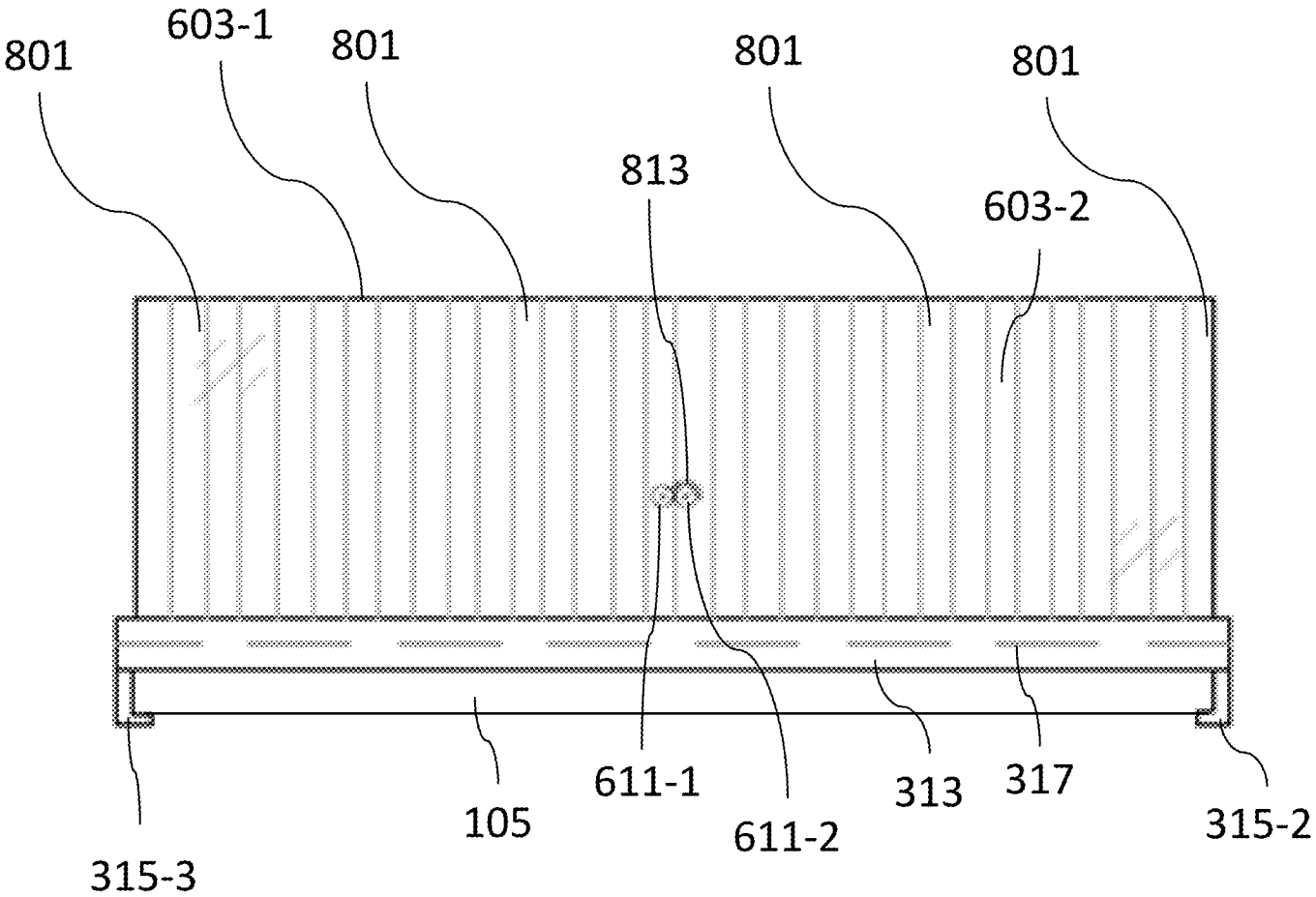
FIG. 9 shows the same view as FIG. 8 but where sections of shield have been slid together so that the shield is closed.

FIG. 9 shows the same view as FIG. 8 but where sections 603-1 and 603-2 have been slid together so that the shield is closed, and hence there is no opening 609. In addition, the lock mechanism is in position such that the shield is locked in the closed position by virtue of hook 813 being over handle 611-2 and a child seated on seat 107 would be unable to open the locking mechanism and hence is unable to open the shield.

Figure 10:
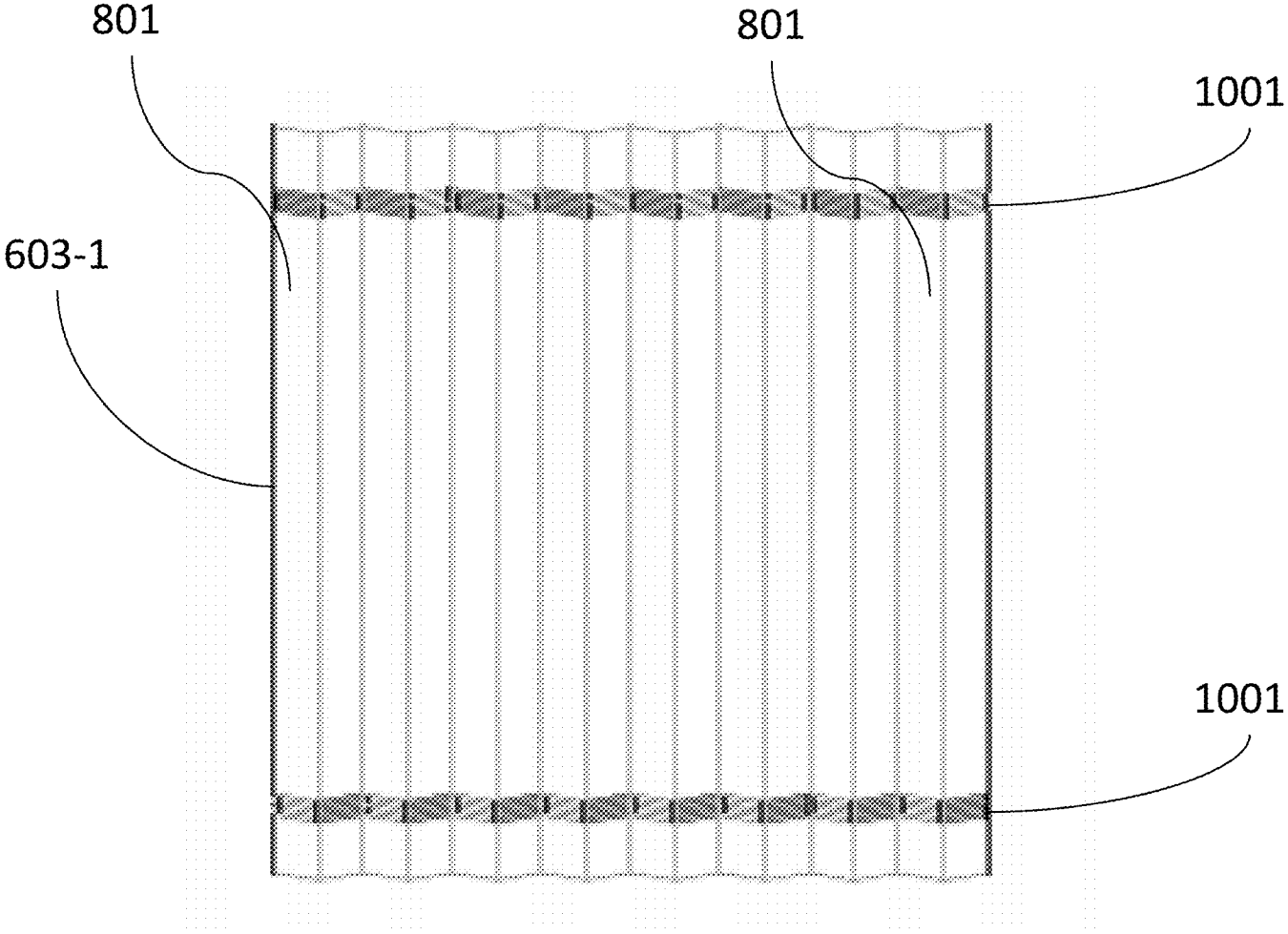
FIG. 10 shows a view of a portion of a shield section that operates in an accordion-like manner according to one embodiment.

FIG. 10 shows a view of a portion of one of shield sections 603 according to one embodiment. In the embodiment shown in FIG. 10, individual panels 801 are coupled together by a dovetail hinge mechanisms 1001 to enable shield sections 603 to operate in an accordion-like manner.

Figure 11:
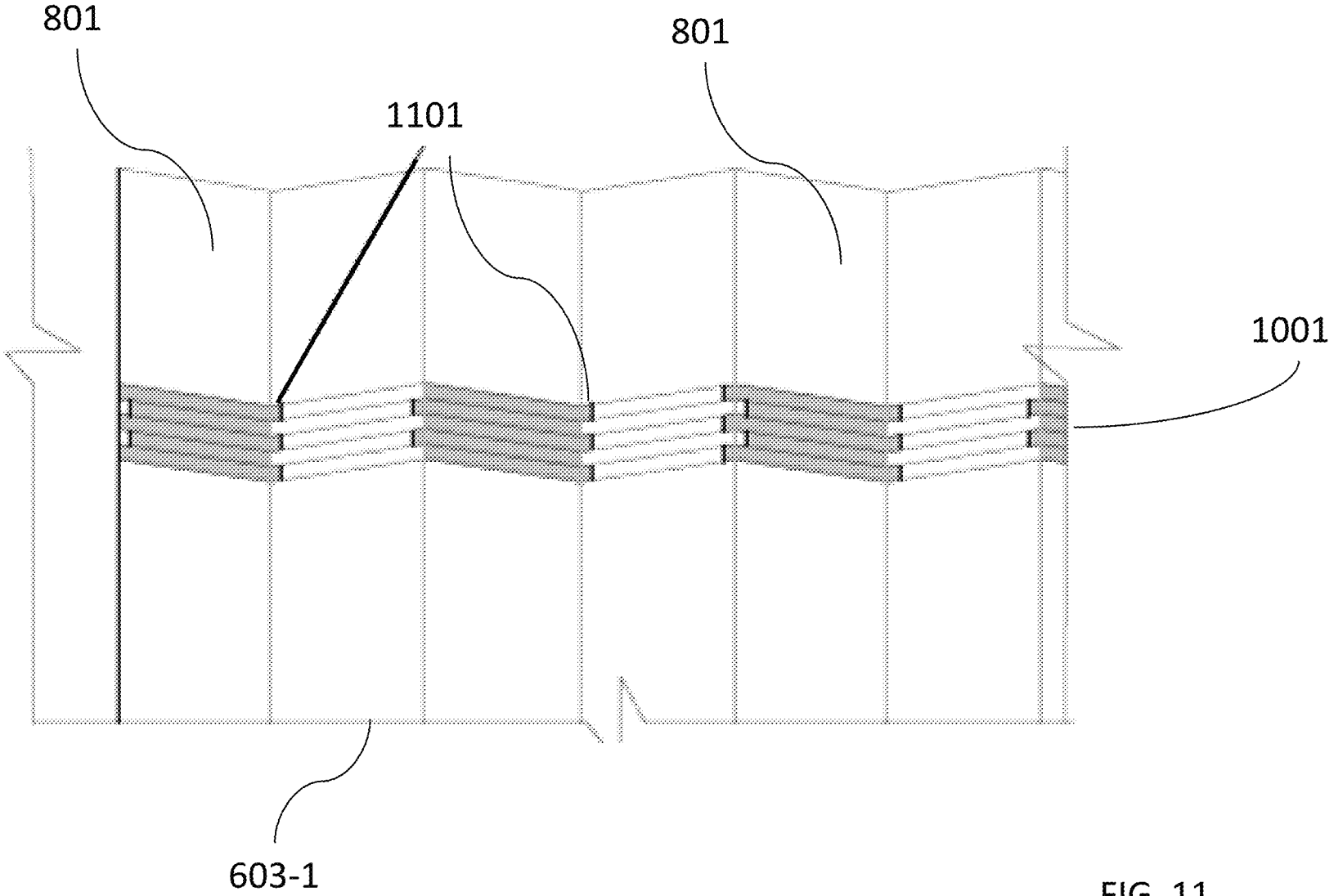
FIG. 11 shows an enlarged view of the panels of FIG. 10 as coupled together by dovetail hinge mechanisms.

FIG. 11 shows an enlarged view of panels 801 as coupled together by dovetail hinge mechanisms 1001. Shown in FIG. 11 is the upper portion of one of shield sections 603. Individual dovetail hinges 1101 can be seen clearly in FIG. 11.

As will be readily recognized by one of ordinary skill in the art, only part of one section 603 may have its plastic sheeting arranged as pleats that collapse in an accordion-like manner.

Figure 12:
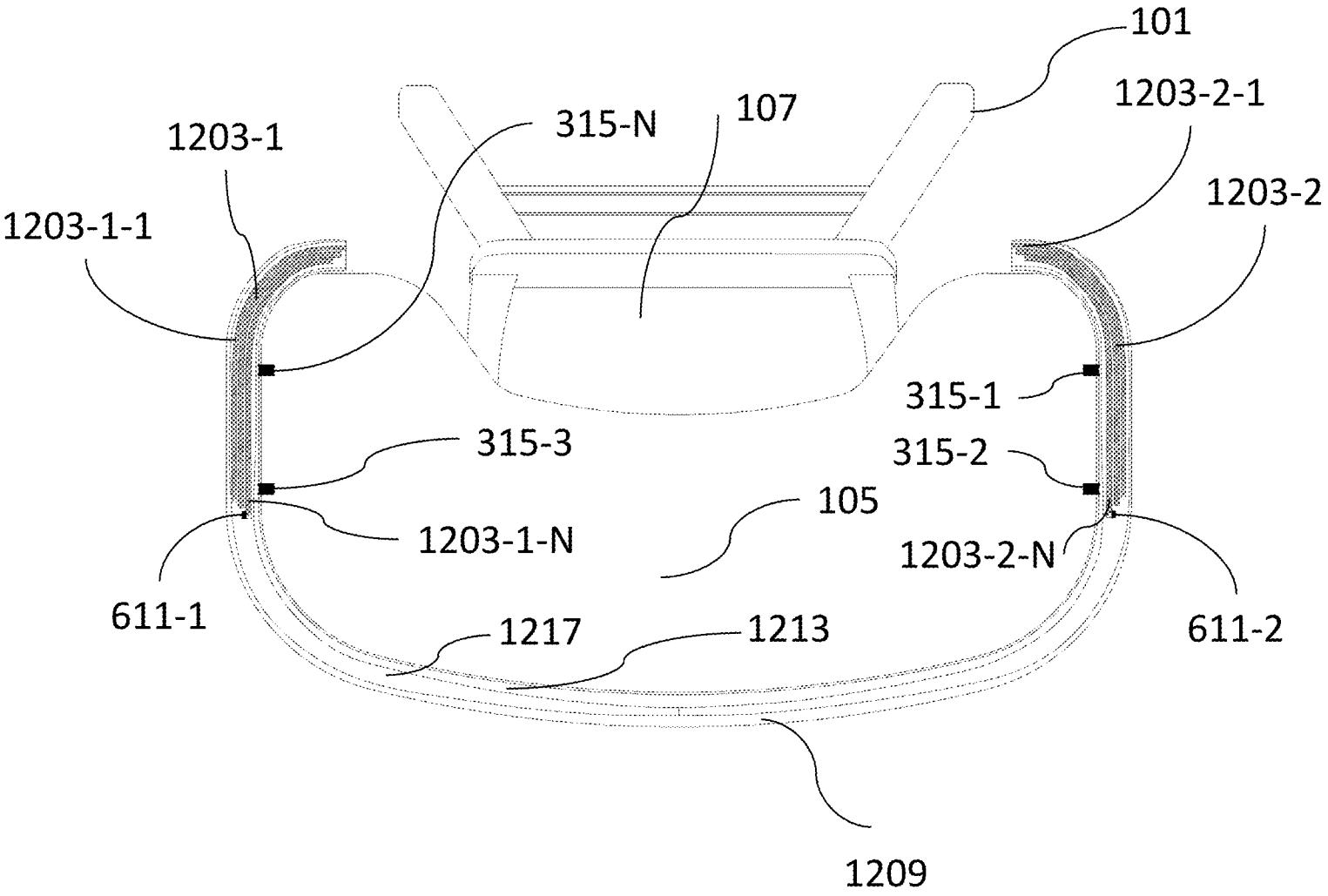
FIG. 12 shows a top view of a highchair having a tray to which is mounted a shield which is made of two sections, where at least one section is arranged as at least two telescoping portions that slide past each other, in accordance with an aspect of the invention.

FIG. 12 shows a top view of highchair 101 including tray 105 to which is mounted another embodiment of the inventive shield, shield 1203, made of two sections, 1203-1 and 1203-2, shield 1203 being openable and closeable, at least partway, to allow for easy access to tray 105, e.g., during the feeding process with a child (not shown) positioned seated on seat 107, while still tray 105 remains attached to high chair 101.

Similar to the embodiment shown in FIG. 1, shield 1203 may be made of flexible plastic sheeting that has sufficient rigidity to maintain its shape and upright standing while yet being flexible enough to curve in accordance with a guide or track on tray 105. In the embodiment shown in FIG. 12 the flexible plastic sheeting of each of sections 1203-1 and 1203-2 of shield 1203 is arranged as at least two telescoping portions, e.g., telescoping portions 1203-1-1 through 1203-1-N and telescoping portions 1203-2-1 through 1203-2-N, respectively, that slide past each other, in accordance with an aspect of the invention. As a result, opening of the shield is achieved by effectively contracting a length of at least one of shield sections and closing of the shield is achieved by effectively extending a length of at least one of the shield sections. In one embodiment, the flexible plastic sheeting has a thickness of approximately one eighth of an inch. Various types of flexible plastic sheeting such as are known in the art, e.g., Plexiglas or other acrylic sheet products, or become known in the art, may be employed.

In FIG. 12, shield 1203 is shown in the open position, by which is meant that shield sections 1203-1 and 1203-2 are retracted, i.e., slid back away from each other and hence telescoping portions 1203-1-1 through 1203-1-N and telescoping portions 1203-2-1 through 1203-2-N are in a collapsed position, to create opening 1209. Advantageously, when shield 1203 is in the open position material, e.g., food, drink or their remnants may be easily added to or removed from tray 105. Further advantageously, because the flexible plastic sheeting of shield 1203 is arranged as at least two telescoping portions, opening 1209 may be larger than, for example, opening 109 (FIG. 1) when the same track length and length of shield when extended is employed.

Also shown in FIG. 12 is track 1213 which, in one embodiment, is removably attached to tray 105 by clips 315-1 through 315-N, where N is an integer, referred to collectively hereinafter as clips 315. Although 4 clips are shown in FIG. 12, any integer number of clips may be employed. Within track 1213 may be formed groove 1217 into which is inserted sections 1203-1 and 1203-2 of shield 1203 in a manner enabling them to slide within groove 1217 and to open and close in telescoping manner, thus enabling the shield to be opened or closed in accordance with the principles of the invention. It should be appreciated that although track 1213 is shown as a single track it may be formed out of several sections. Also, groove 1217 is different from groove 317 in that it widens distally from the front edge of tray 105 in order to accommodate the telescoping sections which pack adjacent to each other as shield 1203 is opened by moving telescoping portions 1203-1-1 through 1203-1-N and telescoping portions 1203-2-1 through 1203-2-N further back from the front of the tray. Groove 1217 may also have some elasticity so that it widens somewhat more when moving telescoping portions 1203-1-1 through 1203-1-N are retracted and narrows somewhat when moving telescoping portions 1203-1-1 through 1203-1-N are positioned to close the shield. Doing so helps to provide additional stability in maintaining shield 1203 in its proper orientation with respect to tray 105. Also shown in FIG. 12 are handles 611, which include handles 611-1 and 611-2, respectively, for use in opening and closing shield 1203.

Figure 13:
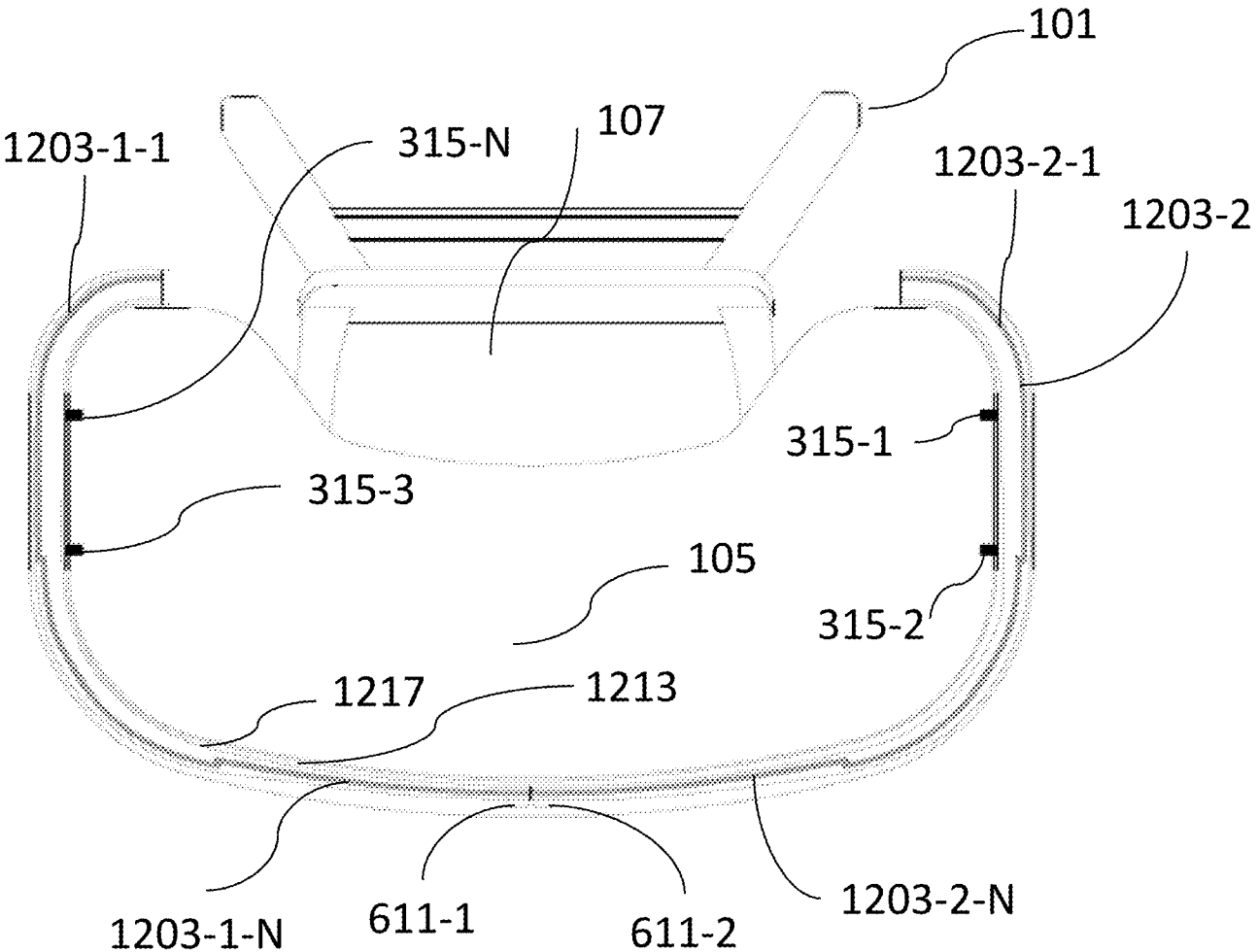
FIG. 13 shows the same view as FIG. 12 but where the sections of the shield have been slid together so that the shield is closed.

FIG. 13 shows the same view as FIG. 12 but where sections 1203-1 and 1203-2 have been slid together so that the shield is closed, and hence there is no opening 1209. Advantageously, in the closed position, shield 1203 provides a barrier such that a child seated on seat 107 is generally prevented from disposing food over and around the front and sides of tray 105. Also shown are handles 611-1 and 611-2 that may be used to open and close shield 1203.

Figure 14:
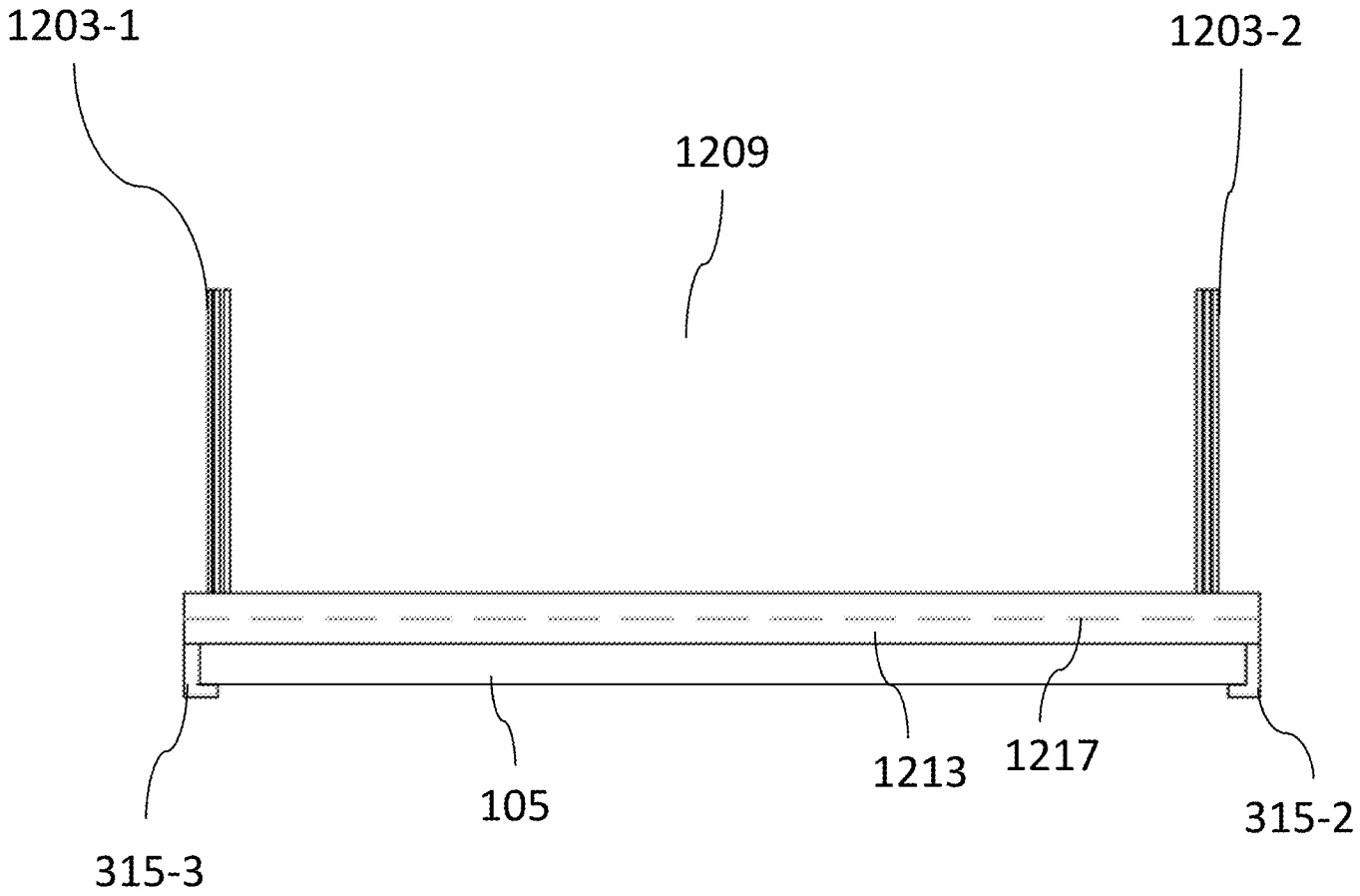
FIG. 14 shows an elevation view straight on from the front of the tray for an embodiment. where moving telescoping portions have been retracted to approximately the position shown in FIG. 12.

FIG. 14 shows an elevation view straight on from the front of tray 105 for an embodiment where moving telescoping portions 1203-1-1 through 1203-1-N and telescoping portions 1203-2-1 through 1203-2-N have been retracted to approximately the position shown in FIG. 12. The dashed line represents the position of track 317 which is not actually visible in the view of FIG. 14.

Figure 15:
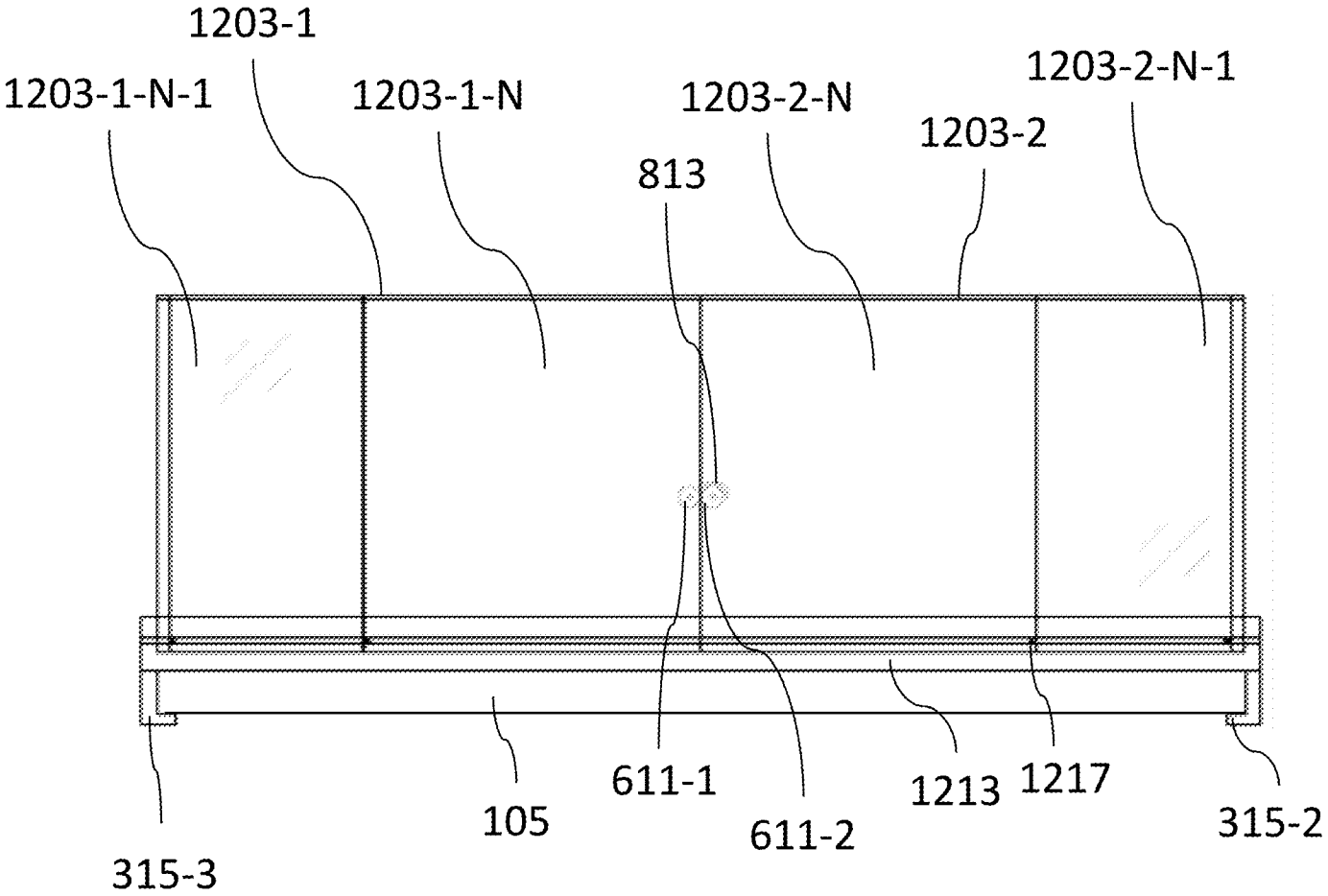
FIG. 15 shows the same view as FIG. 14 but where the shield sections have been slid together so that the shield is closed.

FIG. 15 shows the same view as FIG. 14 but where sections 1203-1 and 1203-2 have been slid together so that the shield is closed, and hence there is no opening 609. Also shown are handles 611-1 and 611-2 that may be used to open and close shield 1203. In addition, locking mechanism, again hook 813, is in position such that the shield is locked in the closed position by virtue of hook 813 being over handle 611-2 and a child seated on seat 107 would be unable to open the locking mechanism and hence is unable to open the shield.

Figure 16:
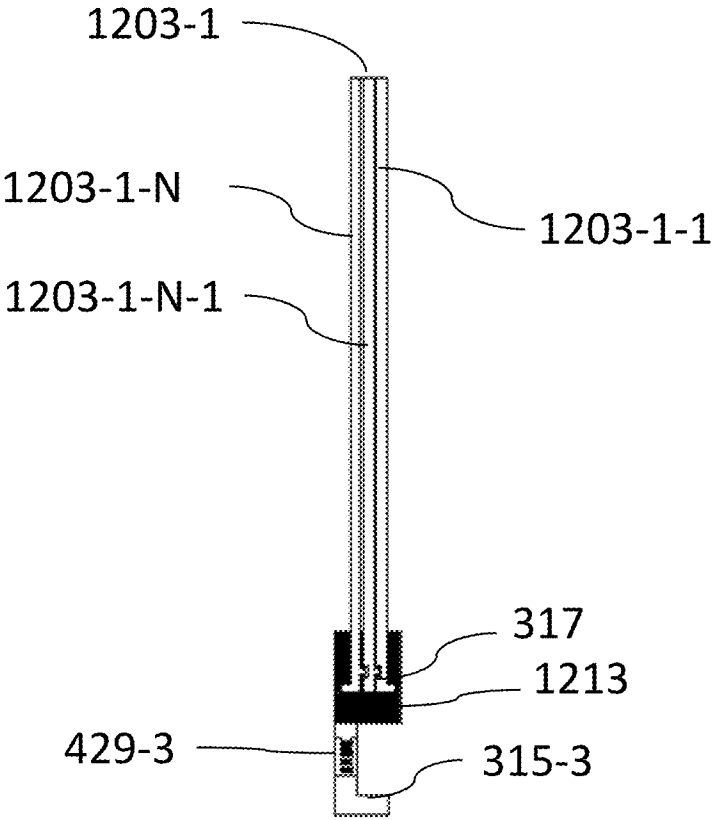
FIG. 16 shows an illustrative arrangement of one of the clips, the track and one of the shield sections of FIG. 14.

FIG. 16 shows an illustrative arrangement of one of clips 315, track 1213, and shield section 1203-1. In the embodiment shown in FIG. 16, track 1213 has within it groove 1217 which has an overall inverted "T" shape. Shield section 1203-1 has in total, i.e., again, overall, a matching inverted "T" shape portion, such that when it is inserted into groove 317 will be generally held therein and be able to slide therethrough. Note, however, that each individual shield telescoping portion, e.g., telescoping portion 1203-N-1, need not have a "T" shape. The height of track 1213 is at the discretion of the implementer but should be sufficient to allow shield 1203 to be securely held thereby. In one embodiment, the height of track 1213 may be around 3 inches. Groove 1217 may penetrate most of the way into track 1213 so as to provide a good grip and hold on shield section 1203-1 so as to maintain it stably in the upright position. In addition, groove 1217 need not be a uniform shape but may have sections that have a shape that match the combinations of those portions of shield sections 1203 that pass therethrough. In one embodiment, shield section 1203-1 may be inserted into groove 1217 by bending the portion of track 1213 that is oppositely located from clip 315-2 to somewhat temporarily widen groove 1217 so that shield section 1203-1 may be placed therein. The same would apply correspondingly shield section 1203-2.

As with the other embodiments, each of clips 315 may be shaped to properly grip one or more high chair tray styles, as the design of high chair trays varies. Thus, clip 315-3 shown in FIG. 16 is illustrative only. In some embodiments, clips 315 may be spring loaded. Clips 315 may be somewhat inherently elastic. The springiness of clip 315-3 is represented in FIG. 16 by element 429-3. In some embodiments, the bottom of the clips may be curved or slanted, e.g., upward or downward. In other embodiments, there may be gripping features molded or attached to the clip. In further embodiments a screw member or similar such item may go through the bottom of the clip to effectuate a clamp or vice grip. In yet further embodiments a ratcheting mechanism may be employed as part of the clip.

Typically track 1213 will rest on the high chair tray 105 (FIG. 12) and clips 313 will hold it securely thereto so that mechanical stability is provided. It may also be arranged that the track is mounted so as to minimize the chance, or amount, of any spilled liquid or thrown food getting in between track 313 and the tray.

Figure 17:
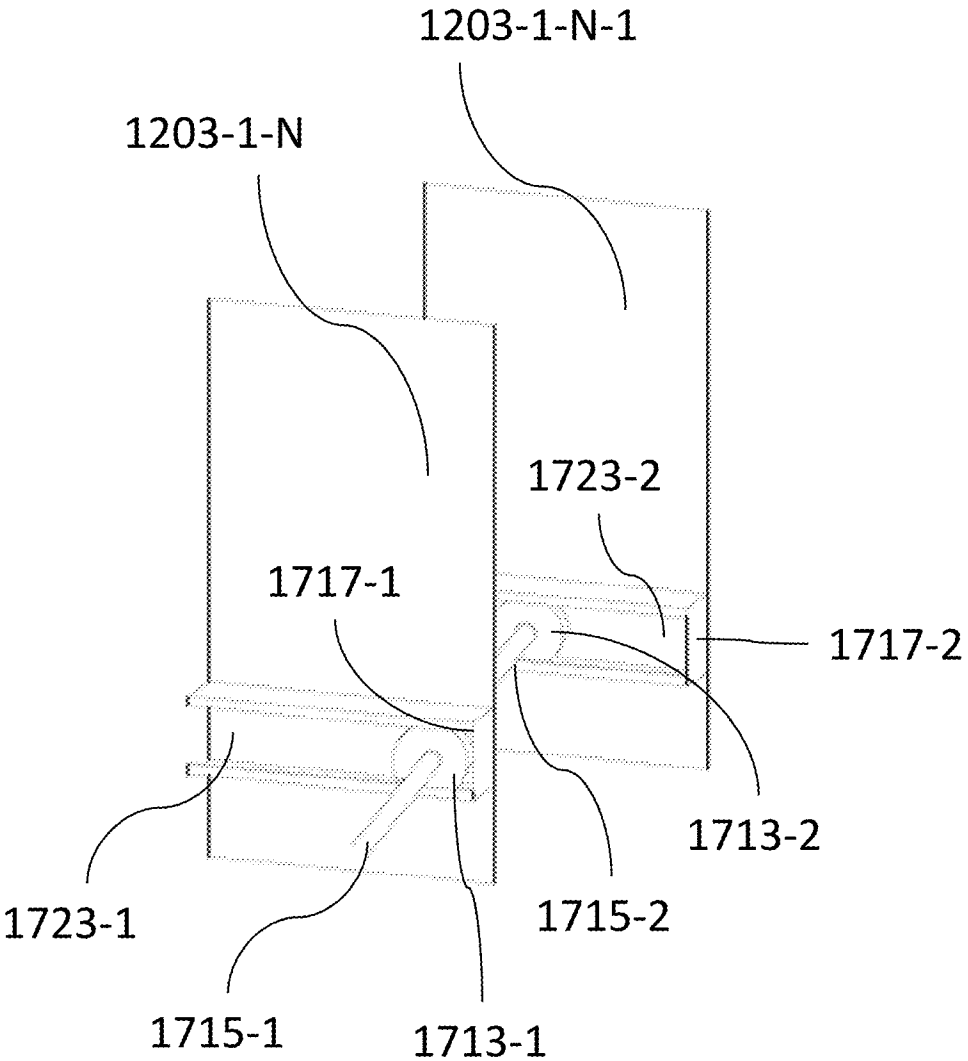
FIG. 17 shows an enlarged view of one implementation of telescoping shield portions as coupled together by representative tracks along with wheels mounted on mini axles.

FIG. 17 shows an enlarged view of one implementation of telescoping portions 1203-1-N and 1203-1-N-1 as coupled together by representative tracks 1723-1 and 1723-2 along with wheels 1713-1 and 1713-2 mounted on mini axles 1715-1 and 1715-2.

In some embodiments, wheels 1713 may rotate around mini axels 1715. In other embodiments, wheels 1713 may simply be fixed to mini axels 1715. In yet further embodiments, wheels 1713 may be dispensed with and mini axels 1715 enlarged to be more peg-like to provide guidance for of telescoping portions 1203-1-N and 1203-1-N-1.

In some embodiments, tracks 1723 may be formed integrally with their respective portions of telescoping portions 1203-1-N and 1203-1-N-1, e.g., by a molding process. In other embodiments, tracks 1723 may be etched out of with their respective portions of telescoping portions 1203-1-N and 1203-1-N-1. The ends of tracks 1723, only one end 1217-1 and 1217-2 for each respective track being shown FIG. 17 for each of telescoping portions 1203-1-N and 1203-1-N-1, are used as stops to control the movement of telescoping portions 1203-1-N and 1203-1-N-1.

In some embodiments, mini axels 1715 may also be formed with their respective portions of telescoping portions 1203-1-N and 1203-1-N-1, e.g., by a molding process. In other embodiments, mini axels 1715 may be affixed to their respective portions of telescoping portions 1203-1-N and 1203-1-N-1, e.g., using glue or a heating process.

Preferably, the arrangement is such that there is a minimal distance between their respective portions of telescoping portions 1203-1-N and 1203-1-N-1 so as to avoid food and liquid getting therebetween. This can be achieved, for example, by controlling the length of mini axels 1715 and the depth of tracks 1723-1 and 1723-2. To this end, another view of the foregoing can be seen in the sectional view of FIG. 16 within track 1213.

As will be readily recognized by one of ordinary skill in the art, only part of one section 1203 may have its plastic sheeting arranged as portions that slide past each other in a telescoping manner.

It will be readily appreciated by those of ordinary skill in the art that the various arrangements for opening and closing the shield may be mixed and matched. Furthermore, it will be appreciated that only one section of the shield needs to be retractable while the other section may be fixed.

Figure 18:
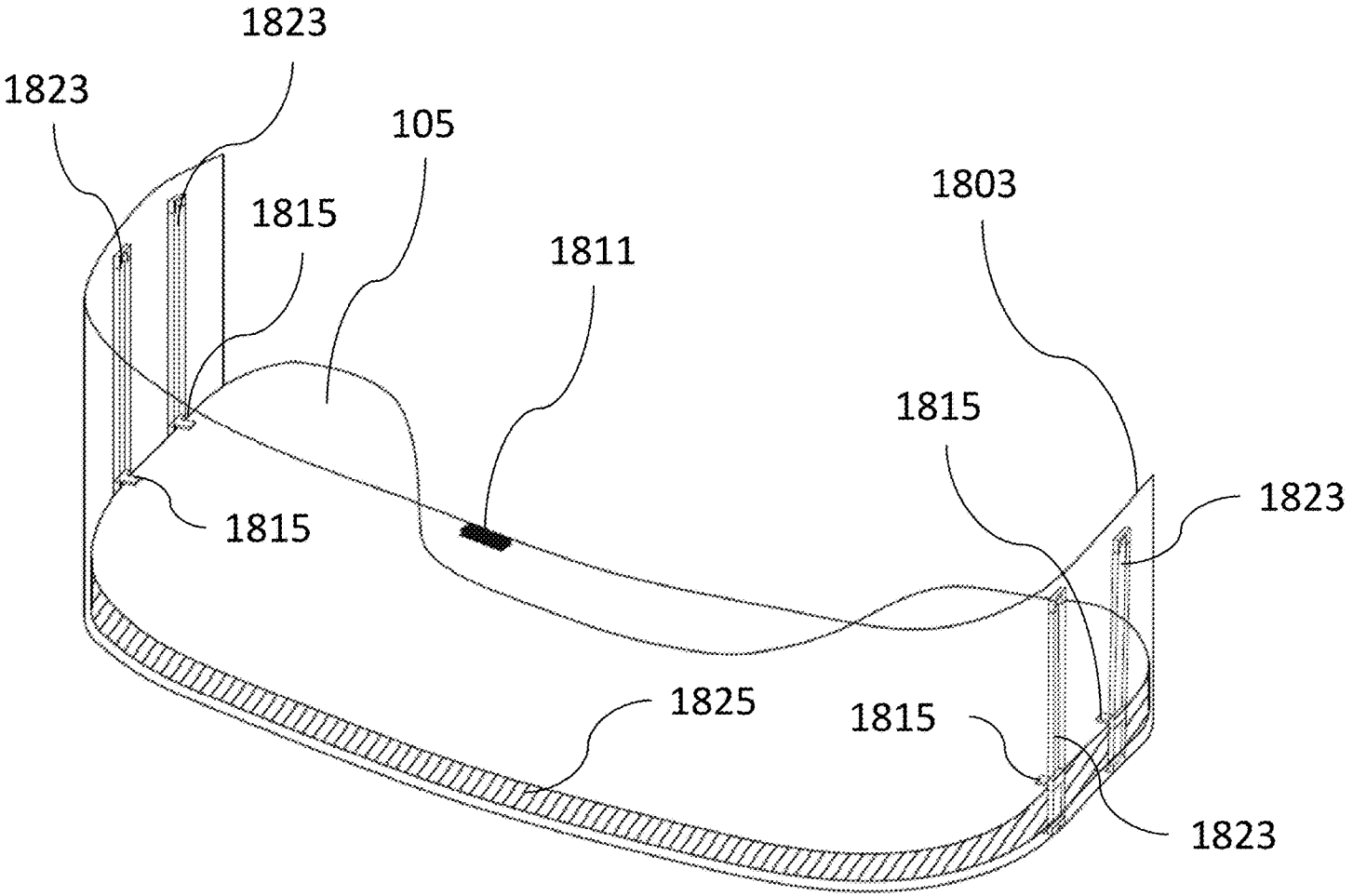
FIG. 18 shows a three-dimensional view of another embodiment of the invention in which the shield is openable and closeable by virtue of being able to slide up and down with respect to the tray in accordance with an aspect of the invention, and in which the shield is in the up, i.e., closed, position.

FIG. 18 shows a three-dimensional view of another embodiment of the invention in which shield 1803 is a single piece of plastic sheeting that has sufficient rigidity to maintain its shape and upright standing while yet being flexible enough to curve in accordance with a tray 105. In one embodiment, the flexible plastic sheeting has a thickness of approximately one eighth of an inch. Various types of flexible plastic sheeting such as are known in the art, e.g., Plexiglas or other acrylic sheet products, or become known in the art, may be employed.

Figure 19:
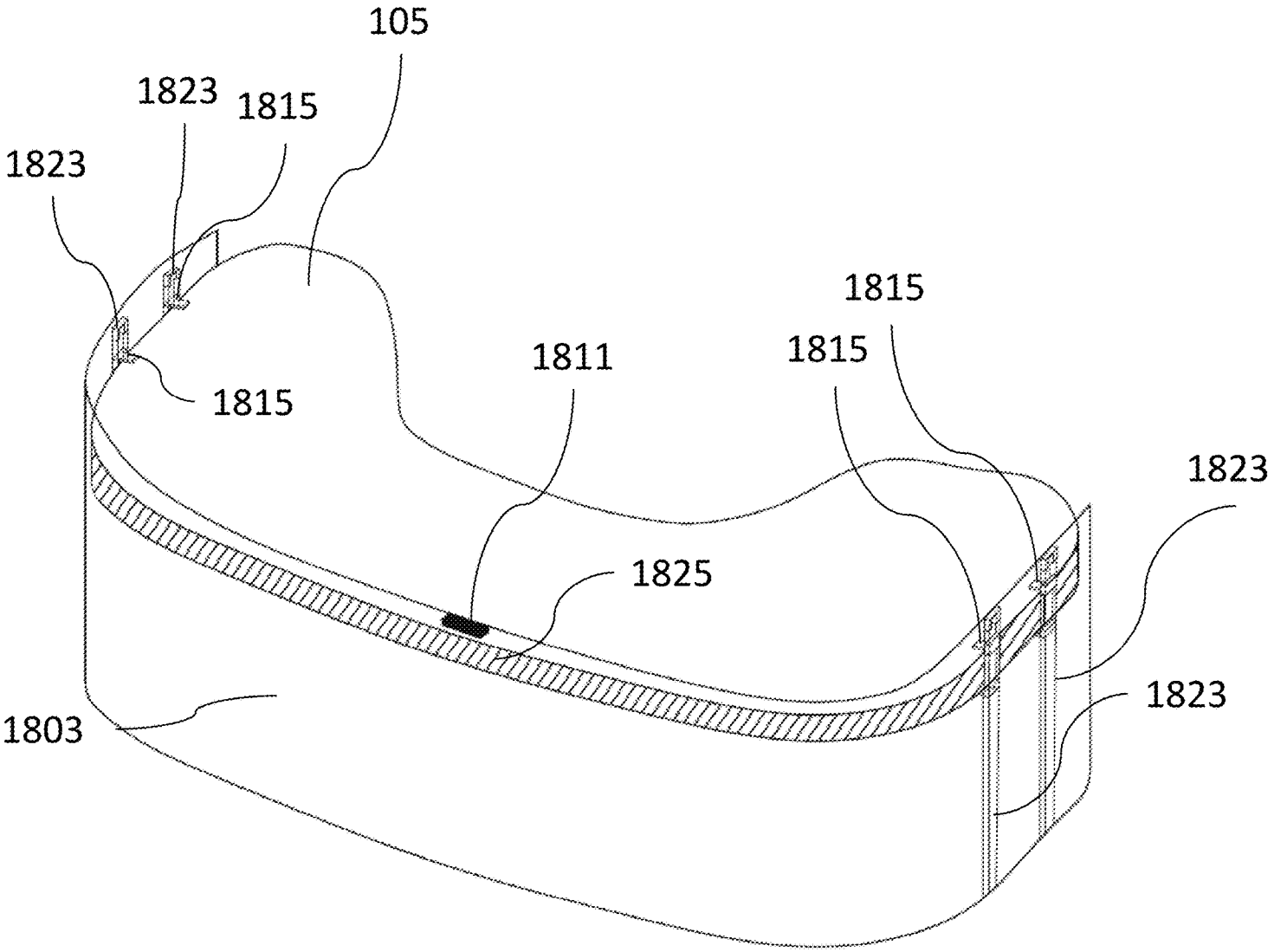
FIG. 19 shows the shield in the down position that corresponds to the open position.

Shield 1803 is transitionable from a first configuration to a second configuration in that it is openable and closeable by virtue of being able to slide up and down with respect to tray 105, in accordance with an aspect of the invention. FIG. 18 shows shield 1803 in the up position corresponding to the closed position. FIG. 19 shows shield 1803 in the down position that corresponds to the open position, in that it, advantageously, allows easy access to the tray so that material, e.g., food, drink or their remnants may be easily added to or removed from tray 105.

FIG. 18 also shows optional handle 1811, which can be used to slide shield 1803 upward and downward so as to move it from open position to closed position and vice-versa. In various embodiments, such handles may also be located on each side, e.g., between tracks 1823, or omitted entirely.

In one embodiment, shield 1803 is removably attached to tray 105 by clips 1815. Although 4 clips are shown in FIG. 18, any integer number of clips may be employed. Each of clips 1815 may be shaped to properly grip one or more high chair tray styles, as the design of high chair trays varies.

Thus, clip 1815 shown in FIG. 18 is illustrative only. In some embodiments, clips 1815 may be spring loaded. In some embodiments, the bottom of the clips may be curved or slanted, e.g., upward or downward. In other embodiments, there may be gripping features molded or attached to the clip. In further embodiments a screw member or similar such item may go through the bottom of the clip to effectuate a clamp or vice grip. In yet further embodiments a ratcheting mechanism may be employed as part of the clip. All of the clips used in any embodiment need not be the same, e.g., they need not all be of the same type, size, or design.

Tracks 1823 are used to guide shield 1803 upward and downward and to keep shield 1803 attached to clips 1815 and hence to tray 105. Tracks 1823 may be integrally formed with shield 1803, e.g., by a molding process. In other embodiments, tracks 1823 may be etched out of shield 1803.

In addition, clips 1815 may be integrated with optional sealing belt 1825 which may extend between the clips around the edge of tray 105 and can prevent food and spills from dripping into a gap that would otherwise exist between shield 1803 and the edge of tray 105. Shield 103 may further include an optional sealing lip, not shown, that may nestle up against sealing belt 1825 or tray 105 to prevent leakage of food or beverage when shield 1803 is in the up position.

Figure 20:
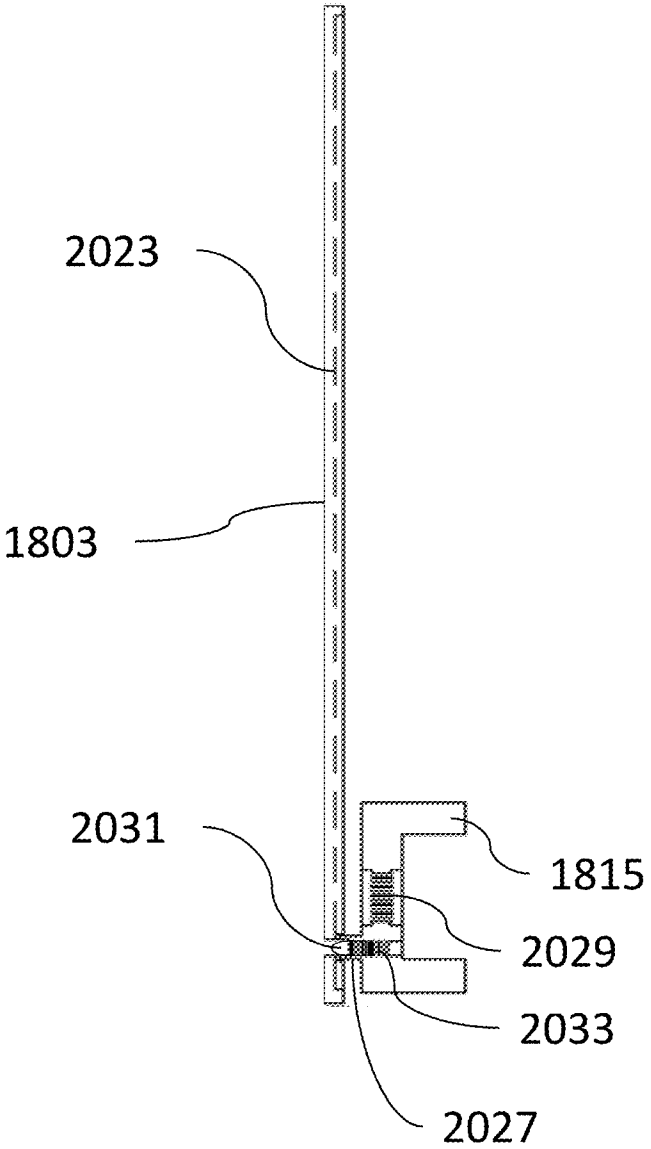
FIG. 20 shows an illustrative arrangement of the shield of FIG. 18 and one of the clips that holds it to the tray when shield is in the up position.

FIG. 20 shows an illustrative arrangement of shield 1803 and one of clips 1815 when shield 1803 is in the up position. Element 2029 represents the springiness or flexibility of clip 1815, which may be implemented in various ways, e.g., as discussed above in connection with clips 315, or as otherwise known in the art. Likewise, clips 1815 may be implemented in a similar manner as discussed above in connection with clips 315.

Dashed line 2023 represents track 1823, which in the embodiment shown is recessed back from the surface of shield 1803 that is closest to tray 105. Guide 2027 is used to guide the track, and hence the movement of shield 1803. A latching mechanism, such as, in one embodiment, a spring, e.g., spring 2033, activates button 2031 that pops out from guide 2027 and through a hole in shield 1803, is used to keep shield 1803 in the up position. In another embodiment a pin or peg may be inserted through a hole in shield 1803 and track 1823 into the side of guide 2027 that is distal from clip 1815 to keep shield 1803 in the up position. In some embodiments, only one of clips 1815 on each side of tray 105 incorporates the latching mechanism for keeping the tray in the up position. For clarity purposes, optional sealing belt 1825 is not shown in FIG. 20.

Figure 21:
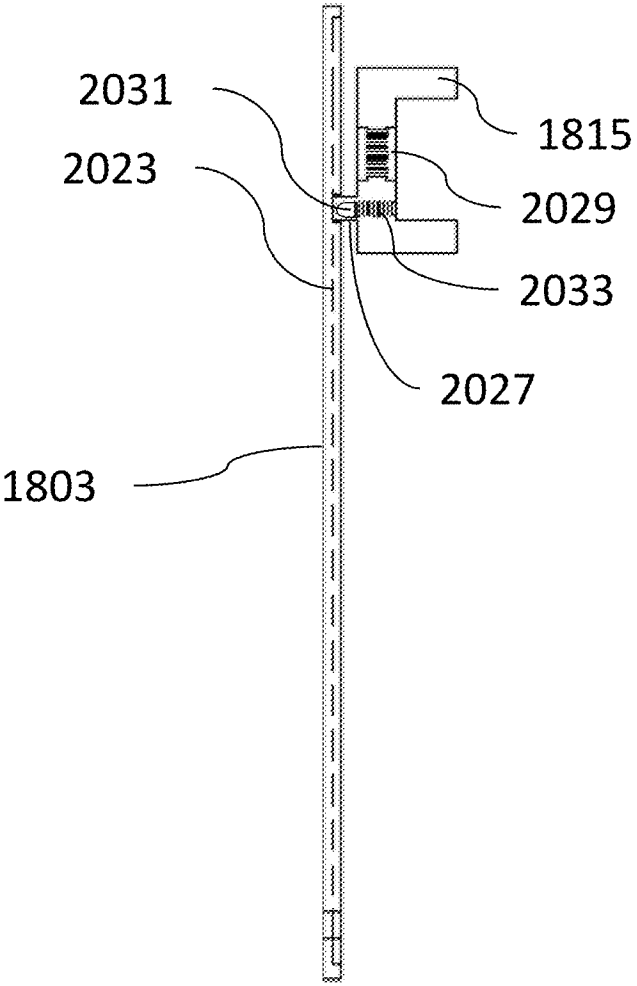
FIG. 21 shows the same view as in FIG. 20 but with shield in the down position.

FIG. 21 shows the same view as in FIG. 20 but with shield 1803 in the down position and button 2031 in a retracted position. In some embodiments, the ending of the track at its top may operate as a stop to prevent shield 1803 from sliding further down. In yet other embodiments, button 2031 may extend through an upper hole in shield 1803 and track 1823 to act as a stop.

In another embodiment of the invention, the shield may be made of more than one portion, at least one of which is arrange to move up and down, while another portion need not do so.

In yet another embodiment, the shield may be affixed to a portion of the high chair other than the tray, so long as it is moveable with respect to the tray.

As will be readily appreciated, the design of the high chair shown in the various FIGS. as well as the shape of the tray and the particular extent to which the shield may extend to the sides of and behind the location of the child are illustrative only for pedagogical purposes. To some degree, this is dependent on the preexisting tray design. Those of ordinary skill in the art will be will be able to apply the principles of the invention to other high chair designs and to differently shaped trays and shield extent without departing from the spirit and scope of the invention. In addition, the shield may be designed to have its own tray that would at least partly go over the preexisting tray of the high chair. Such would enable the shield to have a different shape from, e.g., to extend further toward the back support of the high chair than would otherwise be possible with, the high chair's preexisting tray.

What is claimed is:

1. A shield for a tray for a high chair, the shield mounted on, or configured to be mounted on, the tray substantially adjacent to a peripheral edge of the tray, the shield being openable, at least partway, and closeable while mounted on the tray so that when in a closed condition the shield forms an at least partly enclosed area above an upper surface of the tray, the surface being upper when the tray is substantially in its position of use, opposite to the chair, wherein the shield comprises at least one first section and at least one second section, at least one of the first and second sections being configured to slide relative to the other of the first and second sections over the upper surface of the tray in order to transition the shield between an opened condition and the closed condition.

2. The shield as defined in claim 1 wherein the at least one of the first and second sections is arranged to slide over the upper surface of the tray from a position in which the first and second sections abut so that the shield is in the closed condition to a position providing a gap between the two sections so that the shield is in the opened condition.

3. The shield as defined in claim 2 further comprising a locking mechanism mounted to at least one of the first and second sections and arranged so that when engaged, the locking mechanism holds the first and second sections together.

4. The shield as defined in claim 1 wherein the shield is mounted substantially perpendicular to the upper surface of the tray.

5. The shield as defined in claim 1 wherein when the shield is in the opened condition there is an opening in the shield substantially distal from the high chair.

6. The shield as defined in claim 1 wherein when the shield is in the opened condition there is an opening in the shield to one side of the high chair.

7. The shield as defined in claim 1 wherein the shield is openable by sliding the first and second sections away from each other along the upper surface of the tray and the shield is closeable by sliding the first and second sections toward each other along the upper surface of the tray.

8. The shield as defined in claim 1 wherein at least one of the first and second sections is formed of portions designed to retract to place the shield in the opened condition by the shield portions sliding into one another and to place the shield in the closed condition by the portions sliding out of one another.

9. The shield as defined in claim 1 wherein at least one of the first and second sections is formed of portions designed to open the shield by the portions sliding to be increasingly overlapped and adjacent to each other and to close the shield by the portions sliding oppositely to decrease the relative overlap between the portions.

10. The shield as defined in claim 1 wherein at least one of the first and second sections is formed of portions designed to open the shield by contracting a length of the section and to extend the section's length to close the shield.

11. The shield as defined in claim 1 wherein the shield is retractable substantially along the edge of the upper surface of the tray, whereby when in a retracted position access is provided to the tray from in front of the high chair.

12. The shield as defined in claim 1, wherein the shield is configured to provide a closable opening between at least the first and the second sections while the shield is mounted on the tray.

13. A shield for a tray for a high chair, the shield mounted on or configured to be mounted to a portion of the high chair and having first and second configurations, the shield being in the first configuration when 4 at least a section of the shield is substantially maximally deployed so as to substantially block any of at least one object in the tray's area from being disposed over the tray and beyond an edge of the tray distally from a portion of the tray proximal to a location for a child when seated in the high chair and creating an at least partly enclosed area above an upper surface of the tray opposite to the chair and the second configuration being when the section of the shield is not maximally deployed, wherein the shield comprises at least one track attached or removably attached to the portion of the high chair, wherein the section of the shield defines a shield surface that is not substantially parallel to the upper surface of the tray when the tray is in its position of use, and the section of the shield is guided in the track to move substantially along the edge of the tray.

14. The shield as defined in claim 13 wherein the shield is arranged to slide upward and downward with respect to the tray when the tray is in its position of use, the shield being located substantially along a portion of an outer edge of the tray, and wherein the shield is in the first configuration when it is substantially in a full upward position and the shield is in the second configuration when it is at least somewhat downward from the full upward position.

15. The shield as defined in claim 13 wherein the section of the shield is comprised of at least two portions and wherein a first of the at least two portions of the section of the shield is arranged to slide upward and downward with respect to the tray, the shield being located substantially adjacent to a portion of an outer edge of the tray, and wherein the shield is in the first configuration when the first portion is substantially in the full upward position and the shield is in the second configuration when the first portion is at least somewhat downward from the full upward position.

16. The shield as defined in claim 13 wherein the shield comprises at least two sections, wherein the section is one of the at least two sections, at least one of the at least two sections is arranged to slide along the upper surface of the tray, the surface being upper when the tray is substantially in its position of use, and wherein in the first configuration each of the two sections abut each other and in the second configuration there is a gap between the two sections.

17. The shield as defined in claim 16 wherein at least one of the at least two sections comprises at least two portions.

18. The shield as defined in claim 16 wherein at least one of the at least two sections is configured such that its length is expandable and contractible.

19. The shield as defined in claim 13 wherein the portion of the high chair to which the shield is mounted is the tray.

20. A shield for a tray for a high chair, the shield mounted on or configured to be mounted to the tray of the high chair, the shield comprising (i) a track fixed to or configured to be fixed to an edge of the tray, (ii) at least one first section, and (iii) at least one second section, wherein at least one of the first section and the second section of the shield is configured to be slidably moveable along the track between at least a first position and a second position while remaining attached to the tray of the high chair, and wherein in the first position an opening is provided between the first section and the second section in front of the high chair to access the tray and in the second position there substantially is no such opening provided between the first section and the second section.

* * * * *